US010871153B2

(12) United States Patent
White et al.

(10) Patent No.: US 10,871,153 B2
(45) Date of Patent: Dec. 22, 2020

(54) METHOD OF REDUCING AIR COMPRESSOR NOISE

(75) Inventors: Gary D. White, Medina, TN (US); Dalton E. McFarland, Medina, TN (US); Stephen J. Vos, Jackson, TN (US); Scott D. Craig, Jackson, TN (US)

(73) Assignee: Black & Decker Inc., Newark, DE (US)

( * ) Notice: Subject to any disclaimer, the term of this patent is extended or adjusted under 35 U.S.C. 154(b) by 22 days.

(21) Appl. No.: 13/609,349

(22) Filed: Sep. 11, 2012

(65) Prior Publication Data

US 2013/0064689 A1 Mar. 14, 2013

Related U.S. Application Data

(60) Provisional application No. 61/534,009, filed on Sep. 13, 2011, provisional application No. 61/533,993,
(Continued)

(51) Int. Cl.
*F04B 23/10* (2006.01)
*F04B 39/00* (2006.01)
(Continued)

(52) U.S. Cl.
CPC ..... *F04B 39/0033* (2013.01); *F04B 23/10* (2013.01); *F04B 35/04* (2013.01);
(Continued)

(58) Field of Classification Search
CPC .... F04B 39/0027; F04B 23/10; F04B 39/121; F04B 41/02; F04B 35/06; F04B 39/0061; F04B 39/0055; F04D 19/00; F04D 29/668
(Continued)

(56) References Cited

U.S. PATENT DOCUMENTS 1,381,056 A 6/1921 Blakely
1,469,201 A 9/1923 Whitted et al.
(Continued)

FOREIGN PATENT DOCUMENTS

DE 2751298 A1 5/1979
DE 10117791 A1 10/2002
(Continued)

OTHER PUBLICATIONS

European Search Report for EP 13 28 3932, EPO (dated Nov. 29, 2013).
(Continued)

*Primary Examiner* — Charles G Freay
(74) *Attorney, Agent, or Firm* — Wright IP & International Law; Eric G. Wright

(57) ABSTRACT

A compressor assembly having a tank seal which seals a tank gap between a portion of a housing of the compressor assembly and a portion of a compressed gas tank and a method for controlling the sound level of a compressor assembly by configuring a tank seal to seal a gap between the housing of a compressor assembly and a compressed gas tank. The sound level of the compressor assembly can be controlled by sealing a tank gap between at least a portion of a compressor assembly housing and at least a portion of a compressed gas tank.

20 Claims, 36 Drawing Sheets

Related U.S. Application Data filed on Sep. 13, 2011, provisional application No. 61/534,001, filed on Sep. 13, 2011, provisional application No. 61/534,015, filed on Sep. 13, 2011, provisional application No. 61/534,046, filed on Sep. 13, 2011.

(51) Int. Cl.

| | |
|---|---|
| ***F04B 35/04*** | (2006.01) |
| ***F04B 35/06*** | (2006.01) |
| ***F04B 39/12*** | (2006.01) |
| ***F04B 41/02*** | (2006.01) |
| ***F04D 19/00*** | (2006.01) |
| ***F04D 29/66*** | (2006.01) |
| ***F04B 39/06*** | (2006.01) |

(52) U.S. Cl.

CPC ..... *F04B 35/06* (2013.01); *F04B 39/0027* (2013.01); *F04B 39/0055* (2013.01); *F04B 39/0061* (2013.01); *F04B 39/066* (2013.01); *F04B 39/121* (2013.01); *F04B 41/02* (2013.01); *F04D 19/00* (2013.01); *F04D 29/668* (2013.01); *Y10S 181/403* (2013.01); *Y10T 29/49238* (2015.01); *Y10T 137/7039* (2015.04)

(58) Field of Classification Search

USPC ..... 417/53, 313; 49/490.1, 498.1, 475.1; 277/644, 645

See application file for complete search history.

(56) References Cited

U.S. PATENT DOCUMENTS 1,694,218 A 6/1924 Hazard
1,924,654 A 3/1930 Petersen
2,059,894 A 6/1933 Newman
2,106,488 A 1/1938 McCune
2,107,644 A 2/1938 Ohmart
2,136,098 A * 11/1938 Browne ..... F04B 25/005 137/565.18
2,312,596 A 2/1940 Smith
2,343,952 A 2/1943 Branstrom
2,375,442 A 5/1945 Sandberg
2,450,468 A 10/1948 Cornelius
2,668,004 A 2/1954 Browne
2,673,028 A 3/1954 Cornelius et al.
D181,459 S 11/1957 Bullock
2,928,491 A 3/1960 Crouch
3,370,608 A * 2/1968 Eisenbrand et al. ..... 137/565.17
3,525,606 A 8/1970 Bodine
3,537,544 A 11/1970 King et al.
3,645,651 A 2/1972 Bills
3,710,094 A 1/1973 Monte et al.
3,736,074 A 5/1973 Kilbane et al.
3,771,911 A 11/1973 Turci
3,930,558 A 1/1976 Schnell et al.
3,955,900 A 5/1976 Vinci
3,978,919 A 9/1976 Fachbach et al.
3,980,912 A 9/1976 Panza
4,190,402 A 2/1980 Meece et al.
4,264,282 A 4/1981 Crago
4,283,167 A 8/1981 Bassan et al.
4,289,630 A 9/1981 Schmidt, Jr. et al.
4,302,224 A 11/1981 McCombs et al.
D263,216 S 3/1982 Maher
4,342,573 A 8/1982 McCombs et al.
4,401,418 A 8/1983 Fritchman
4,460,319 A 7/1984 Ashikian
4,492,533 A 1/1985 Tsuge
4,516,657 A 5/1985 Allard
4,553,903 A 11/1985 Ashikian
4,566,800 A 1/1986 Bodine
4,722,673 A 2/1988 Grime et al.
4,907,546 A 3/1990 Ishii et al.
4,928,480 A 5/1990 Oliver et al.
4,950,133 A 8/1990 Sargent
4,988,268 A 1/1991 Kurihara
5,020,973 A 6/1991 Lammers
5,082,019 A 1/1992 Tetrault
5,133,475 A 7/1992 Sharp
5,137,434 A 8/1992 Wheeler et al.
5,143,772 A * 9/1992 Iwasa ..... 428/122
5,145,335 A 9/1992 Abelen et al.
D335,407 S 5/1993 Ngian et al.
5,213,484 A 5/1993 Hashimoto et al.
5,252,035 A 10/1993 Lee
5,311,090 A 5/1994 Ferlatte
5,311,625 A 5/1994 Barker et al.
5,336,046 A 8/1994 Hashimoto et al.
5,407,330 A 4/1995 Rimington et al.
5,417,258 A 5/1995 Privas
5,509,790 A 4/1996 Schuderi et al.
5,526,228 A 6/1996 Dickson et al.
5,620,370 A 4/1997 Umai et al.
5,647,314 A 7/1997 Matsumura et al.
5,678,543 A 10/1997 Bower
5,725,361 A 3/1998 Dantlgraber
6,023,938 A 2/2000 Taras et al.
6,091,160 A 7/2000 Kouchi et al.
6,099,268 A * 8/2000 Pressel ..... 417/360
6,100,599 A 8/2000 Kouchi
6,145,974 A 11/2000 Shinada et al.
D437,581 S 2/2001 Aruga et al.
D437,825 S 2/2001 Imai
6,206,654 B1 3/2001 Cassidy
D444,796 S 7/2001 Morgan
D444,797 S 7/2001 Davis et al.
6,257,842 B1 7/2001 Kawasaki et al.
6,331,740 B1 12/2001 Morohoshi et al.
D454,357 S 3/2002 Diels
6,357,338 B2 3/2002 Montgomery
6,362,533 B1 3/2002 Morohoshi et al.
6,364,632 B1 4/2002 Cromm et al.
6,378,468 B1 4/2002 Kouchi et al.
6,378,469 B1 4/2002 Hiranuma et al.
6,386,833 B1 5/2002 Montgomery
D461,196 S 8/2002 Buck
6,428,283 B1 8/2002 Bonior
6,428,288 B1 8/2002 King
6,431,839 B2 8/2002 Gruber et al.
6,435,076 B2 8/2002 Montgomery
6,447,257 B2 9/2002 Orschell
6,454,527 B2 9/2002 Nishiyama et al.
6,474,954 B1 11/2002 Bell et al.
6,554,583 B1 4/2003 Pressel
6,571,561 B1 * 6/2003 Aquino et al. ..... 60/772
6,616,415 B1 * 9/2003 Renken et al. ..... 417/44.1
6,682,317 B2 1/2004 Chen
6,720,098 B2 4/2004 Raiser
6,751,941 B2 6/2004 Edelman et al.
6,784,560 B2 8/2004 Sugimoto et al.
6,790,012 B2 9/2004 Sharp et al.
6,814,659 B2 11/2004 Cigelske, Jr.
D499,431 S 12/2004 Chen
6,952,056 B2 10/2005 Brandenburg et al.
6,962,057 B2 11/2005 Kurokawa et al.
6,991,436 B2 1/2006 Beckman et al.
6,998,725 B2 2/2006 Brandenburg et al.
D517,009 S 3/2006 Xiao
D521,929 S 5/2006 Xiao
D531,193 S 10/2006 Caito
7,147,444 B2 12/2006 Cheon
D536,348 S 2/2007 Bass
D536,708 S 2/2007 Bass
7,189,068 B2 3/2007 Thomas, Jr. et al.
D551,141 S 9/2007 Canitano
7,283,359 B2 10/2007 Bartell et al.
7,306,438 B2 12/2007 Kang et al.
7,316,291 B2 1/2008 Thomsen et al.
D566,042 S 4/2008 Yamasaki et al.
D568,797 S 5/2008 Elwell

(56) References Cited

U.S. PATENT DOCUMENTS

| | | | | |
|---|---|---|---|---|
| D572,658 | S | 7/2008 | Yamamoto et al. | |
| 7,392,770 | B2 | 7/2008 | Xiao | |
| 7,398,747 | B2 | 7/2008 | Onodera et al. | |
| 7,398,855 | B2 | 7/2008 | Seel | |
| 7,400,501 | B2 | 7/2008 | Bartell et al. | |
| D576,723 | S | 9/2008 | Achen | |
| 7,430,992 | B2 | 10/2008 | Murakami et al. | |
| 7,452,256 | B2 | 11/2008 | Kasai et al. | |
| 7,491,264 | B2 | 2/2009 | Tao et al. | |
| D588,987 | S | 3/2009 | Kato | |
| D589,985 | S | 4/2009 | Steinfels | |
| D593,032 | S | 5/2009 | Wang et al. | |
| 7,541,701 | B2 | 6/2009 | Lin et al. | |
| 7,563,077 | B2 | 7/2009 | Santa Ana | |
| D600,205 | S | 9/2009 | Imai | |
| 7,597,340 | B2 | 10/2009 | Hirose et al. | |
| 7,614,473 | B2 | 11/2009 | Ono et al. | |
| 7,643,284 | B2 | 1/2010 | Nakamura | |
| 7,678,165 | B2 | 3/2010 | Tingle et al. | |
| 7,707,711 | B2 | 5/2010 | Bartell et al. | |
| 7,743,739 | B2 | 6/2010 | Kochi et al. | |
| 7,762,790 | B2 * | 7/2010 | Steinfels | F04B 35/06 137/565.18 |
| 7,779,792 | B2 | 8/2010 | Kubo et al. | |
| 7,779,793 | B2 | 8/2010 | Ito et al. | |
| 7,811,653 | B2 * | 10/2010 | Miyakawa et al. | 428/122 |
| 7,854,517 | B2 | 12/2010 | Tsubura | |
| 8,215,448 | B2 | 7/2012 | Harting et al. | |
| 8,230,968 | B2 | 7/2012 | Jung et al. | |
| 8,246,320 | B2 | 8/2012 | Park et al. | |
| 8,316,987 | B2 | 11/2012 | Ishida et al. | |
| 8,327,975 | B2 | 12/2012 | Ortman et al. | |
| 8,584,795 | B1 | 11/2013 | Buckner | |
| 8,770,341 | B2 | 7/2014 | Wood et al. | |
| 8,899,378 | B2 | 12/2014 | Wood et al. | |
| 8,967,324 | B2 | 3/2015 | White et al. | |
| 8,992,186 | B2 | 3/2015 | Silveira et al. | |
| 9,309,876 | B2 | 4/2016 | Wood et al. | |
| 9,476,416 | B2 | 10/2016 | Chen | |
| 2002/0009372 | A1 | 1/2002 | Gruber et al. | |
| 2002/0134617 | A1 | 9/2002 | Nissen et al. | |
| 2002/0185333 | A1 | 12/2002 | Svendsen | |
| 2004/0103683 | A1 | 6/2004 | Yoon | |
| 2005/0092544 | A1 | 5/2005 | Lee | |
| 2005/0220640 | A1 | 10/2005 | Finkenbinder et al. | |
| 2005/0247750 | A1 | 11/2005 | Burkholder et al. | |
| 2006/0104830 | A1 | 5/2006 | Fields | |
| 2006/0104833 | A1 | 5/2006 | Hueppchen | |
| 2006/0104834 | A1 | 5/2006 | Stilwell | |
| 2006/0104837 | A1 | 5/2006 | Lee et al. | |
| 2006/0137522 | A1 * | 6/2006 | Nishimura | A61M 16/10 95/96 |
| 2008/0008603 | A1 | 1/2008 | Schoegler | |
| 2008/0045368 | A1 | 2/2008 | Nishihara | |
| 2008/0053746 | A1 | 3/2008 | Albert et al. | |
| 2008/0069703 | A1 | 3/2008 | Beckman | |
| 2008/0152518 | A1 | 6/2008 | Stilwell | |
| 2008/0181794 | A1 | 7/2008 | Steinfels et al. | |
| 2008/0187447 | A1 | 8/2008 | Steinfels et al. | |
| 2009/0016902 | A1 | 1/2009 | Lee et al. | |
| 2009/0050219 | A1 | 2/2009 | Firoenza et al. | |
| 2009/0114476 | A1 | 5/2009 | Lewis et al. | |
| 2010/0112929 | A1 | 5/2010 | Iantorno | |
| 2010/0192878 | A1 | 8/2010 | Mustafa | |
| 2010/0225012 | A1 | 9/2010 | Fitton et al. | |
| 2010/0226750 | A1 | 9/2010 | Gammack | |
| 2010/0226771 | A1 | 9/2010 | Crawford et al. | |
| 2010/0226787 | A1 | 9/2010 | Gammack et al. | |
| 2010/0239438 | A1 | 9/2010 | Kinjo et al. | |
| 2010/0290929 | A1 | 11/2010 | Ohi et al. | |
| 2010/0317281 | A1 | 12/2010 | Sperandio et al. | |
| 2011/0094052 | A1 | 4/2011 | Witter | |
| 2011/0095540 | A1 | 4/2011 | Jackson et al. | |
| 2011/0158828 | A1 | 6/2011 | Nutz et al. | |
| 2011/0182754 | A1 | 7/2011 | Gathers et al. | |

FOREIGN PATENT DOCUMENTS

| | | | |
|---|---|---|---|
| DE | 10117791 | A | 3/2003 |
| EP | 2320085 | A2 | 5/2011 |
| EP | 2706234 | A1 | 3/2014 |
| FR | 919265 | | 3/1947 |
| JP | 54041562 | A | 4/1979 |
| JP | 1080793 | A | 3/1989 |
| JP | 4232390 | A | 8/1992 |
| JP | 5133330 | A | 5/1993 |
| JP | 7109977 | A | 4/1995 |
| JP | 9250456 | A | 9/1997 |
| JP | 9250457 | A | 9/1997 |
| JP | 10148135 | A | 6/1998 |
| JP | 10339268 | A | 12/1998 |
| JP | 2003065241 | A1 | 10/2002 |
| JP | 2003065241 | A | 3/2003 |
| JP | 2006292243 | A | 10/2006 |
| WO | 2006062223 | A1 | 6/2006 |
| WO | 2006090345 | A2 | 8/2006 |
| WO | 2008021251 | A2 | 2/2008 |
| WO | 2009152594 | A1 | 12/2009 |
| WO | 2010092790 | A1 | 8/2010 |

OTHER PUBLICATIONS

European Search Report for EP 13 18 4002, EPO (dated Nov. 29, 2013).

Extended European Search Report, EP Application No. 12 184 258.7, EPO (dated Feb. 16, 2017).

Extended European Search Report, EP Application No. 15 201 260.5, EPO (dated May 6, 2016).

Thomas Pumps & Compressors, WOB-L Piston, Technical Document, pp. 1-2 (2002).

LaBelle et al., Design and Development of an Old Concept Using New Materials to Produce an Air Compressor, Thomas Industries Power Air Division, pp. 68-72 (1978), International Computer Engineering Conference, Paper 248, http://docs.lib.purdue.edu/iced/248.

Extended European Search Report, EP Application No. 13183932.6, EPO (dated Nov. 29, 2013).

Communication Pursuant to Article 94(3) EPC, Application No. 12 184 220.7-1004, EPO (dated Jun. 19, 2020).

Communication Pursuant to Article 94(3) EPC, Application No. 12 184 220.7-1004, EPO (dated Jan. 24, 2019).

Extended European Search Report, Application No. 12184220.7-1616/2570669, EPO (dated Feb. 14, 2017).

* cited by examiner

| Sound Level | Pump Air Delivery | Maximum Pressure | Heat Transfer Rate | Cooling Fan Flowrate | Pump Speed | Cylinder Bore | Stroke | Swept Volume | Volumetric Efficiency | Input Power | Motor Efficiency |
|---|---|---|---|---|---|---|---|---|---|---|---|
| (dBA) | (SCFM@90 psig) | (psig) | BTU/min | (CFM) | (rpm) | (inches) | (inches) | inches^3 | (% at 150 psig) | (Watts) | (%) |
| 65 – 75 | 2.4 - 3.5 | | | | | | | | | | |
| 65 – 75 | | 150 - 250 | | | | | | | | | |
| 65 – 75 | | | 60 - 200 | | | | | | | | |
| 65 – 75 | | | | 50 - 100 | | | | | | | |
| 65 – 75 | 2.4 - 3.5 | 150 - 250 | 60 - 200 | | | | | | | | |
| 65 – 75 | 2.4 - 3.5 | 150 - 250 | | 50 - 100 | | | | | | | |
| 65 – 75 | 2.4 - 3.5 | 150 - 250 | | | 1500 - 3000 | 1.5 - 2.25 | 1.3 - 2 | | | | |
| 65 – 75 | 2.4 - 3.5 | 150 - 250 | | | | | | 2.3 - 8 | 33 - 50 | | |
| 65 – 75 | 2.4 - 3.5 | 150 - 250 | | | | | | | | 1000-1800 | 45 - 65 |

FIG. 17

| Sound Level | Pump Air Delivery | Maximum Pressure | Heat Transfer Rate | Cooling Fan Flowrate | Pump Speed | Cylinder Bore | Stroke | Swept Volume | Volumetric Efficiency | Input Power | Motor Efficiency |
|---|---|---|---|---|---|---|---|---|---|---|---|
| (dBA) | (SCFM@90 psig) | (psig) | BTU/min | (CFM) | (rpm) | (inches) | (inches) | inches^3 | (% at 150 psig) | (Watts) | (%) |
| 65 – 75 | | | | | 1500 - 3000 | | | | | | |
| 65 – 75 | | | | | | 1.5 - 2.25 | | | | | |
| 65 – 75 | | | | | | | 1.3 - 2 | | | | |
| 65 – 75 | | | | | | | | 2.3 - 8 | | | |
| 65 – 75 | | | | | | | | | 33 - 50 | | |
| 65 – 75 | | | | | | | | | | 1000-1800 | |
| 65 – 75 | 2.4 - 3.5 | 150 - 250 | 60 - 200 | 50 - 100 | | | | | | | 45 - 65 |
| 65 – 75 | | | | | 1500 - 3000 | 1.5 - 2.25 | | | | | |
| 65 – 75 | 2.4 - 3.5 | 150 - 250 | 60 - 200 | 50 - 100 | 1500 - 3000 | 1.5 - 2.25 | 1.3 - 2 | | | | |
| 65 – 75 | 2.4 - 3.5 | 150 - 250 | 60 - 200 | 50 - 100 | 1500 - 3000 | 1.5 - 2.25 | 1.3 - 2 | 2.3 - 8 | 33 - 50 | 1000-1800 | 45 - 65 |

FIG. 18

| Sound Level | Pump Air Delivery | Maximum Pressure | Heat Transfer Rate | Cooling Fan Flowrate | Pump Speed | Cylinder Bore | Stroke | Swept Volume | Volumetric Efficiency | Input Power | Motor Efficiency |
|---|---|---|---|---|---|---|---|---|---|---|---|
| (dBA) | (SCFM@90 psig) | (psig) | BTU/min | (CFM) | (rpm) | (inches) | (inches) | inches^3 | (% at 150 psig) | (Watts) | (%) |
| 70.5 | 2.9 | | | 71.5 | | | | | | | |
| 70.5 | 2.9 | | | | 2300 | 1.875 | 1.592 | | | | |
| 70.5 | 2.9 | | | | | | | 4.4 | 41 | | |
| 70.5 | 2.9 | | | | | | | | | 1446 | 56.5 |
| 70.5 | 2.9 | 200 | 84.1 | | | | | | | | |
| 70.5 | 2.9 | 200 | | 71.5 | | | | | | | |
| 70.5 | 2.9 | 200 | | | 2300 | 1.875 | 1.592 | | | | |
| 70.5 | 2.9 | 200 | | | | | | 4.4 | 41 | | |
| 70.5 | 2.9 | 200 | | | | | | | | 1446 | 56.5 |
| 70.5 | 2.9 | | 84.1 | | | | | | | | |
| 70.5 | 2.9 | | | 71.5 | | | | | | | |
| 70.5 | 2.9 | | | | 2300 | | | | | | |
| 70.5 | 2.9 | | | | | | | | | 1446 | |
| 70.5 | | 200 | 84.1 | | | | | | | | |
| 70.5 | | 200 | | 71.5 | | | | | | | |
| 70.5 | | 200 | | | 2300 | | | | | | |
| 70.5 | | 200 | | | | | | | | 1446 | |
| 70.5 | | | 84.1 | 71.5 | | | | | | | |
| 70.5 | | | 84.1 | | 2300 | | | | | | |
| 70.5 | | | | | | | | | | 1446 | |

FIG. 19

| Sound Level | Pump Air Delivery | Maximum Pressure | Heat Transfer Rate | Cooling Fan Flowrate | Pump Speed | Cylinder Bore | Stroke | Swept Volume | Volumetric Efficiency | Input Power | Motor Efficiency |
|---|---|---|---|---|---|---|---|---|---|---|---|
| (dBA) | (SCFM@90 psig) | (psig) | BTU/min | (CFM) | (rpm) | (inches) | (inches) | inches^3 | (% at 150 psig) | (Watts) | (%) |
| 70.5 | 2.9 | 200 | 84.1 | 71.5 | | | | | | | |
| 70.5 | 2.9 | 200 | 84.1 | | 2300 | | | | | | |
| 70.5 | 2.9 | 200 | 84.1 | 71.5 | 2300 | | | | | | |
| 70.5 | 2.9 | 200 | 84.1 | | | 1.875 | | | | | |
| 70.5 | 2.9 | 200 | 84.1 | | | | 1.592 | | | | |
| 70.5 | 2.9 | 200 | 84.1 | 71.5 | 2300 | | | | | | |
| 70.5 | 2.9 | 200 | 84.1 | 71.5 | 2300 | 1.875 | | | | | |
| 70.5 | 2.9 | 200 | 84.1 | 71.5 | 2300 | | 1.592 | | | | |
| 70.5 | 2.9 | 200 | 84.1 | 71.5 | 2300 | 1.875 | 1.592 | | | | |
| 70.5 | 2.9 | 200 | 84.1 | | | | | 4.4 | | | |
| 70.5 | 2.9 | 200 | 84.1 | | | | | | 41 | | |
| 70.5 | 2.9 | 200 | 84.1 | 71.5 | 2300 | 1.875 | 1.592 | 4.4 | | | |
| 70.5 | 2.9 | 200 | 84.1 | 71.5 | 2300 | 1.875 | 1.592 | 4.4 | 41 | | |
| 70.5 | 2.9 | 200 | 84.1 | | | | | | | 1446 | |
| 70.5 | 2.9 | 200 | 84.1 | | | | | | | | 56.5 |
| 70.5 | 2.9 | 200 | 84.1 | 71.5 | 2300 | 1.875 | 1.592 | 4.4 | 41 | 1446 | |
| 70.5 | 2.9 | 200 | 84.1 | 71.5 | 2300 | 1.875 | 1.592 | 4.4 | 41 | 1446 | 56.5 |

FIG. 20

| | Compressor Assembly Performance Data |
|---|---|
| Motor Speed (RPM) | 11200 |
| Pump Speed (RPM) | 2300 |
| Voltage | 120 |
| Air Flow (SCFM) @ 90 psi | 2.9 |
| Current Draw @ 90 psi (amps) | 11.8 |
| Volumetric Efficiency @ 90 psi | 49.6% |
| Motor Torque (lb-in) @ 90 psi | 6.01 |
| Motor Efficiency @ 90 psi | 56.3% |
| Air Flow (SCFM) @ 150 psi | 2.4 |
| Current Draw @ 150 psi (amps) | 12.05 |
| Volumetric Efficiency @ 150 psi | 41.0% |
| Motor Torque (lb-in) @ 150 psi | 6.16 |
| Motor Efficiency @ 150 psi | 56.5% |
| Air Flow (SCFM) @ 200 psi | 2.15 |
| Current Draw @ 200 psi (amps) | 11.88 |
| Volumetric Efficiency @ 200 psi | 36.7% |
| Motor Torque (lb-in) @ 200 psi | 6.06 |
| Motor Efficiency @ 200 psi | 56.4% |
| Cylinder Bore (inches) | 1.875 |
| Cylinder Stroke (inches) | 1.592 |
| Cylinder Swept Volume (cubic inches) | 4.40 |
| Sound Level (dBA) | 70.5 |
| Heat Transfer Rate (BTU/min) | 84.1 |

FIG. 21

METHOD OF REDUCING AIR COMPRESSOR NOISE

CROSS-REFERENCE TO RELATED APPLICATIONS

This patent application claims benefit of the filing date under 35 USC § 120 of U.S. provisional patent application No. 61/533,993 entitled "Air Ducting Shroud For Cooling An Air Compressor Pump And Motor" filed on Sep. 13, 2011. This patent application claims benefit of the filing date under 35 USC § 120 of U.S. provisional patent application No. 61/534,001 entitled "Shroud For Capturing Fan Noise" filed on Sep. 13, 2011. This patent application claims benefit of the filing date under 35 USC § 120 of U.S. provisional patent application No. 61/534,009 entitled "Method Of Reducing Air Compressor Noise" filed on Sep. 13, 2011. This patent application claims benefit of the filing date under 35 USC § 120 of U.S. provisional patent application No. 61/534,015 entitled "Tank Dampening Device" filed on Sep. 13, 2011. This patent application claims benefit of the filing date under 35 USC § 120 of U.S. provisional patent application No. 61/534,046 entitled "Compressor Intake Muffler And Filter" filed on Sep. 13, 2011.

INCORPORATION BY REFERENCE

This patent application incorporates by reference in its entirety U.S. provisional patent application No. 61/533,993 entitled "Air Ducting Shroud For Cooling An Air Compressor Pump And Motor" filed on Sep. 13, 2011. This patent application incorporates by reference in its entirety U.S. provisional patent application No. 61/534,001 entitled "Shroud For Capturing Fan Noise" filed on Sep. 13, 2011. This patent application incorporates by reference in its entirety U.S. provisional patent application No. 61/534,009 entitled "Method Of Reducing Air Compressor Noise" filed on Sep. 13, 2011. This patent application incorporates by reference in its entirety U.S. provisional patent application No. 61/534,015 entitled "Tank Dampening Device" filed on Sep. 13, 2011. This patent application incorporates by reference in its entirety U.S. provisional patent application No. 61/534,046 entitled "Compressor Intake Muffler And Filter" filed on Sep. 13, 2011.

FIELD OF THE INVENTION

The invention relates to a compressor for air, gas or gas mixtures.

BACKGROUND OF THE INVENTION

Compressors are widely used in numerous applications. Existing compressors can generate a high noise output during operation. This noise can be annoying to users and can be distracting to those in the environment of compressor operation. Non-limiting examples of compressors which generate unacceptable levels of noise output include reciprocating, rotary screw and rotary centrifugal types. Compressors which are mobile or portable and not enclosed in a cabinet or compressor room can be unacceptably noisy. However, entirely encasing a compressor, for example in a cabinet or compressor room, is expensive, prevents mobility of the compressor and is often inconvenient or not feasible. Additionally, such encasement can create heat exchange and ventilation problems. There is a strong and urgent need for a quieter compressor technology.

When a power source for a compressor is electric, gas or diesel, unacceptably high levels of unwanted heat and exhaust gases can be produced. Additionally, existing compressors can be inefficient in cooling a compressor pump and motor. Existing compressors can use multiple fans, e.g. a compressor can have one fan associated with a motor and a different fan associated with a pump. The use of multiple fans adds cost manufacturing difficulty, noise and unacceptable complexity to existing compressors. Current compressors can also have improper cooling gas flow paths which can choke cooling gas flows to the compressor and its components. Thus, there is a strong and urgent need for a more efficient cooling design for compressors.

SUMMARY OF THE INVENTION

In an embodiment, the compressor assembly disclosed herein can have a tank seal which seals a tank gap between a portion of a housing of the compressor assembly and a portion of a compressed gas tank; and a sound level of the compressor assembly which is in a range of from 65 dBA to 75 dBA when the compressor assembly is in a compressing state.

The compressor assembly can have a difference in sound level between a location at a pump assembly side of the tank seal and the outside of the tank seal is in a range of from about 2 dBA to about 10 dBA. The compressor assembly can have a difference in sound level between a location at a pump assembly side of the tank seal and the outside of the tank seal is in a range of from about 2 dBA to about 8 dBA. The compressor assembly can have a difference in sound level between a location at a pump assembly side of the tank seal and the outside of the tank seal is in a range of from about 2.5 dBA to about 5 dBA. The compressor assembly can have a difference in sound level between a location at a pump assembly side of the tank seal and the outside of the tank seal is in a range of from about 5 dBA to about 8 dBA. The compressor assembly can have a difference in sound level between a location at a pump assembly side of the tank seal and the outside of the tank seal is about 2.5 dBA. The compressor assembly can have a difference in sound level between a location at a pump assembly side of the tank seal and the outside of the tank seal is about 5.0 dBA. The compressor assembly can have a difference in sound level between a location at a pump assembly side of the tank seal and the outside of the tank seal is about 8.0 dBA.

The compressor assembly can have a tank seal having a seal bulb. The compressor assembly can have a tank seal having a housing seal. The compressor assembly can have a tank seal having a seal hook. The compressor assembly can have a tank seal having a seal rib. The compressor assembly can have a tank seal having seal bulb which can be compressed.

In an aspect, the compressor assembly disclose herein can control the sound level of the compressor assembly by a method having the steps of: providing a compressor assembly having a housing; providing a compressed gas tank; configuring the housing and compressed gas tank to have tank gap between the housing and the compressed gas tank; providing a tank seal; and sealing the tank gap with the tank seal.

The method for controlling having the step of operating the compressor assembly in a compressing state at a sound level in a range of between 65 dBA and 75 dBA. The method for controlling the sound level of a compressor assembly having the steps of operating the compressor assembly in a compressing state at a sound level in a range of between 65 dBA and 75 dBA, and compressing 2.4 SCFM to 3.5 SCFM of gas.

The method for controlling the sound level of a compressor assembly according to claim 13, further having the steps of operating the compressor assembly in a compressing state at a sound level in a range of between 65 dBA and 75 dBA, and compressing gas to a pressure of 50 PSIG to 250 PSIG.

The method for controlling the sound level of a compressor assembly can have the step of transferring heat from a pump assembly at a rate of from 60 BTU/min to 200 BTU/min.

In an aspect, the compressor assembly disclosed herein can have a means for controlling the sound level of a compressor assembly, which uses a means to seal a tank gap between at least a portion of a housing and at least a portion of a compressed gas tank and by operating the compressor assembly in a range of from 65 dBA to 75 dBA when the compressor assembly is in a compressing state. The compressor assembly can have a means for controlling the sound level of a compressor assembly, wherein a means to seal a tank gap is used which has a deformable portion.

BRIEF DESCRIPTION OF THE DRAWINGS

The present invention in its several aspects and embodiments solves the problems discussed above and significantly advances the technology of compressors. The present invention can become more fully understood from the detailed description and the accompanying drawings, wherein:

FIG. 17 is a first table of embodiments of compressor assembly ranges of performance characteristics;

FIG. 18 is a second table of embodiments of compressor assembly ranges of performance characteristics;

FIG. 19 is a first table of example performance characteristics for an example compressor assembly;

FIG. 20 is a second table of example performance characteristics for an example compressor assembly;

FIG. 21 is a table containing a third example of performance characteristics of an example compressor assembly;

Herein, like reference numbers in one figure refer to like reference numbers in another figure.

DETAILED DESCRIPTION OF THE INVENTION

Figure 2:
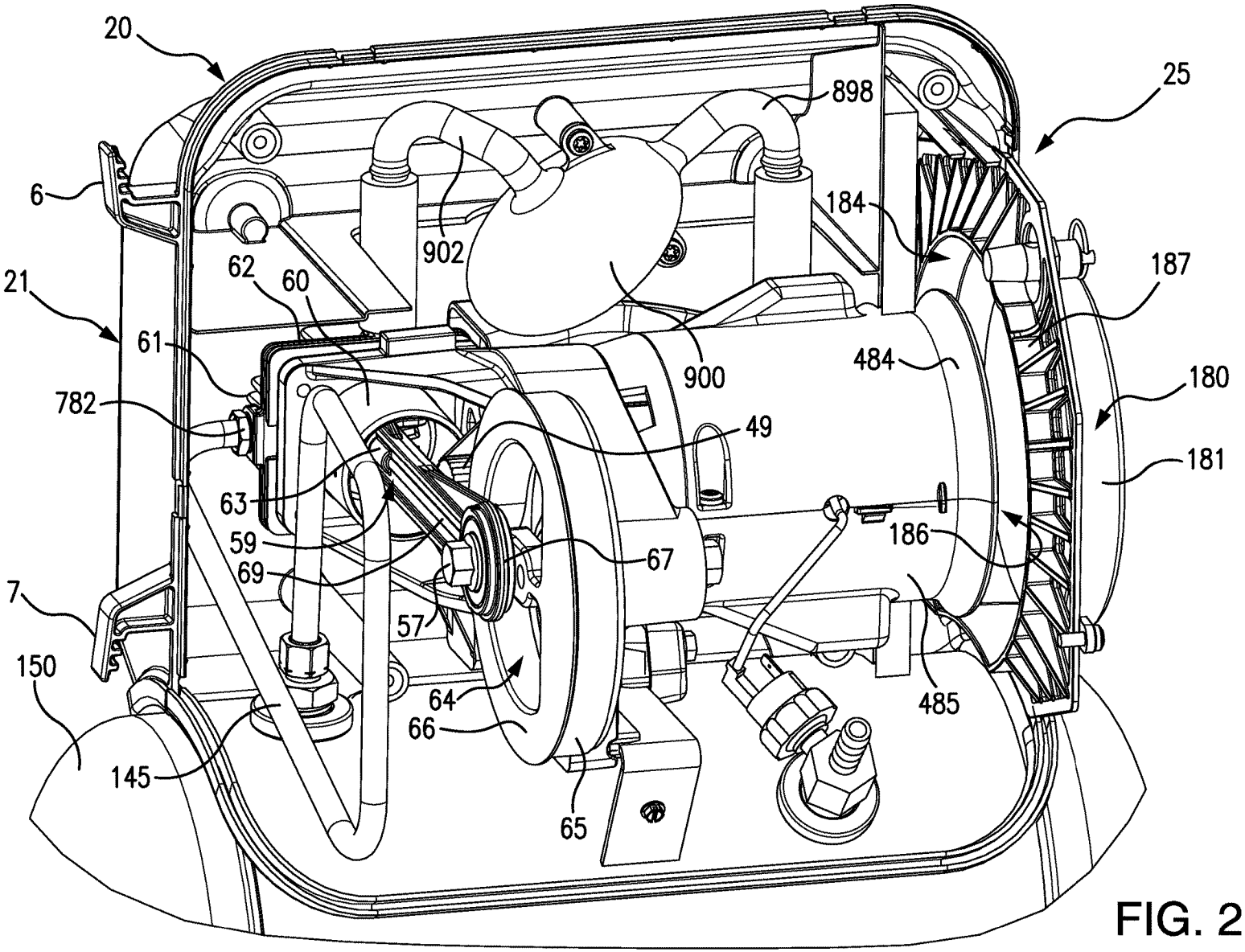
FIG. 2 is a front view of internal components of the compressor assembly.
Figure 3:
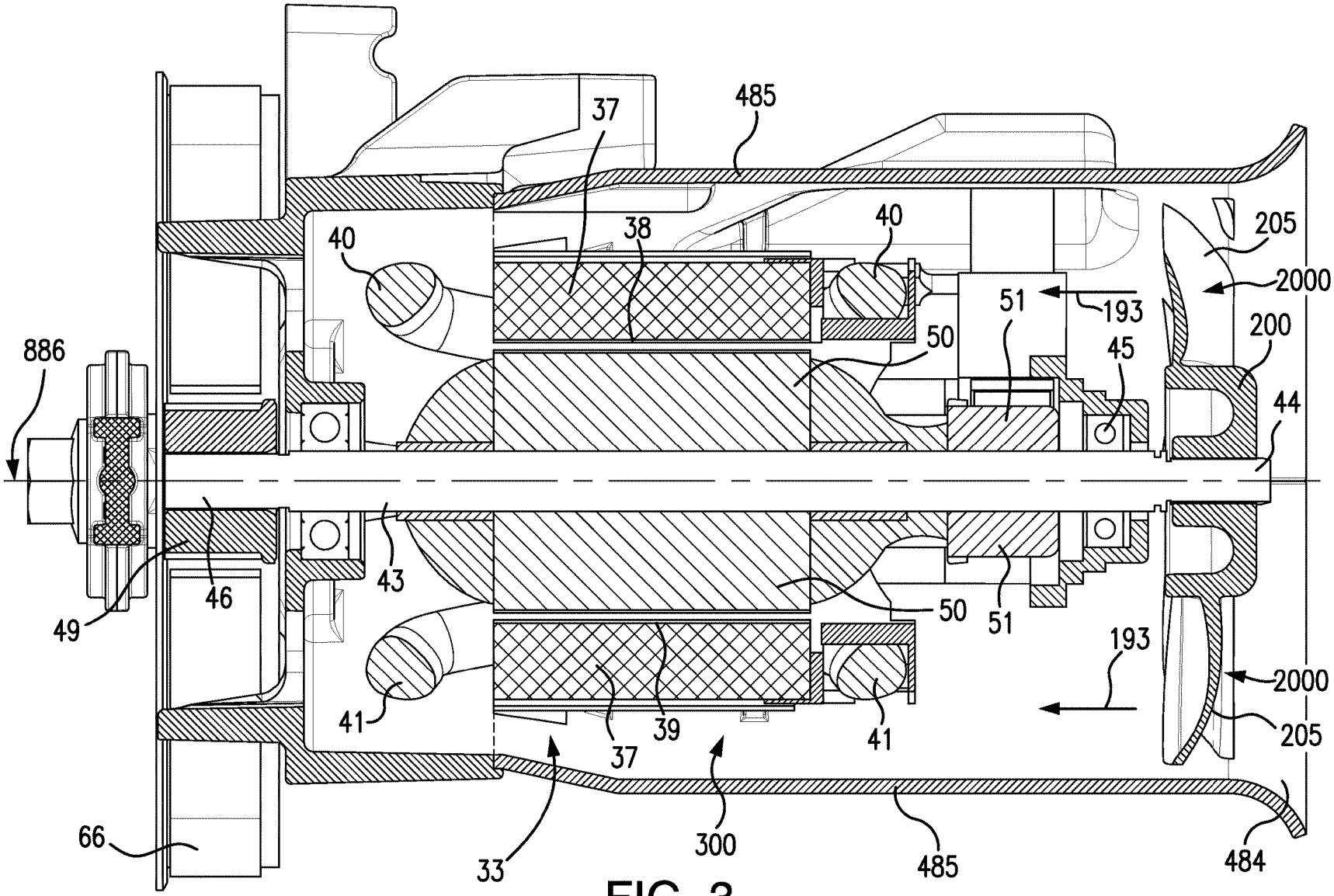
FIG. 3 is a front sectional view of the motor and fan assembly.
Figure 4:
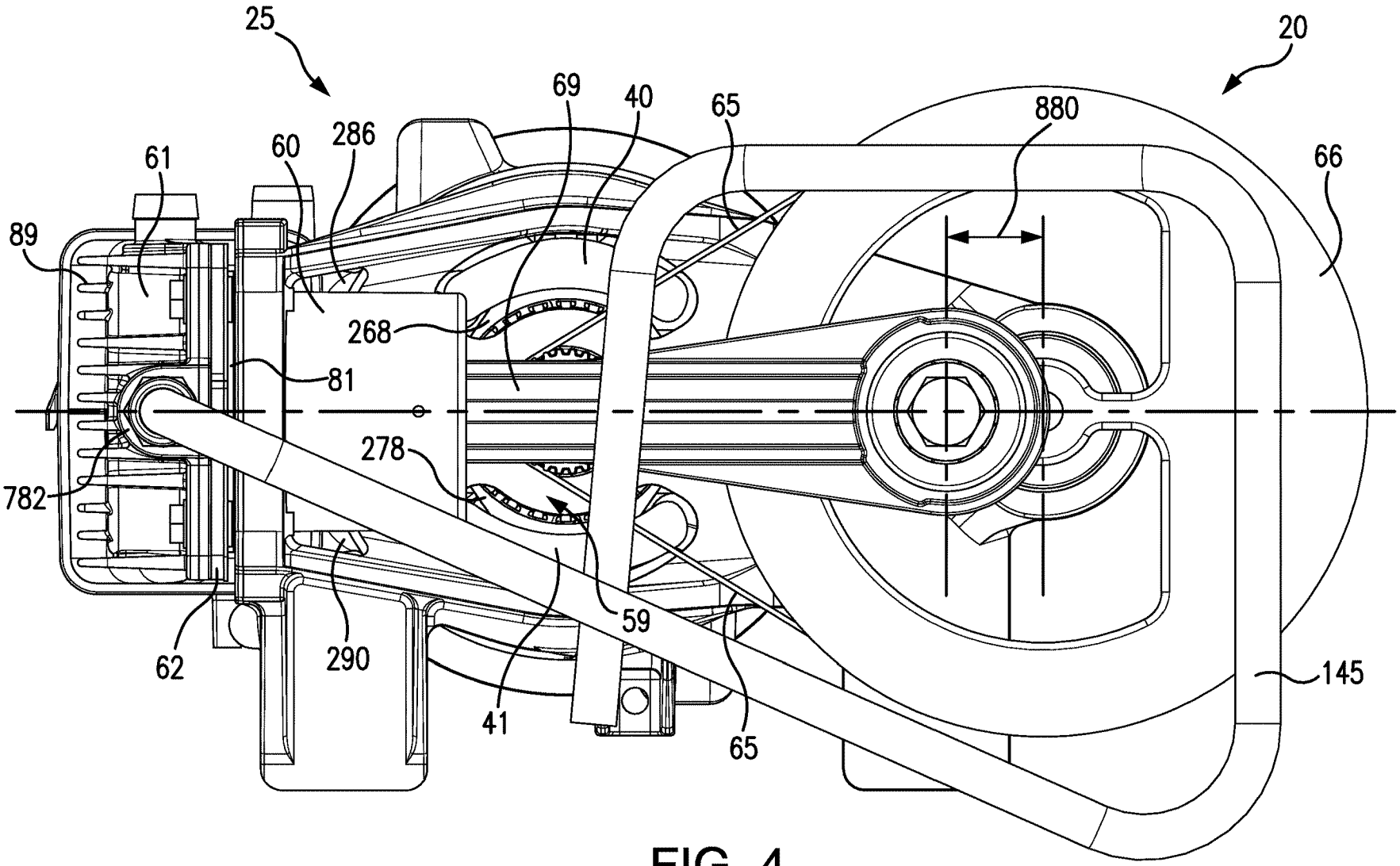
FIG. 4 is a pump-side view of components of the pump assembly.

The invention relates to a compressor assembly which can compress air, or gas, or gas mixtures, and which has a low noise output, effective cooling means and high heat transfer. The inventive compressor assembly achieves efficient cooling of the compressor assembly 20 (FIG. 1) and/or pump assembly 25 (FIG. 2) and/or the components thereof (FIGS. 3 and 4). In an embodiment, the compressor can compress air. In another embodiment, the compressor can compress one or more gases, inert gases, or mixed gas compositions. The disclosure herein regarding compression of air is also applicable to the use of the disclosed apparatus in its many embodiments and aspects in a broad variety of services and can be used to compress a broad variety of gases and gas mixtures.

Figure 1:
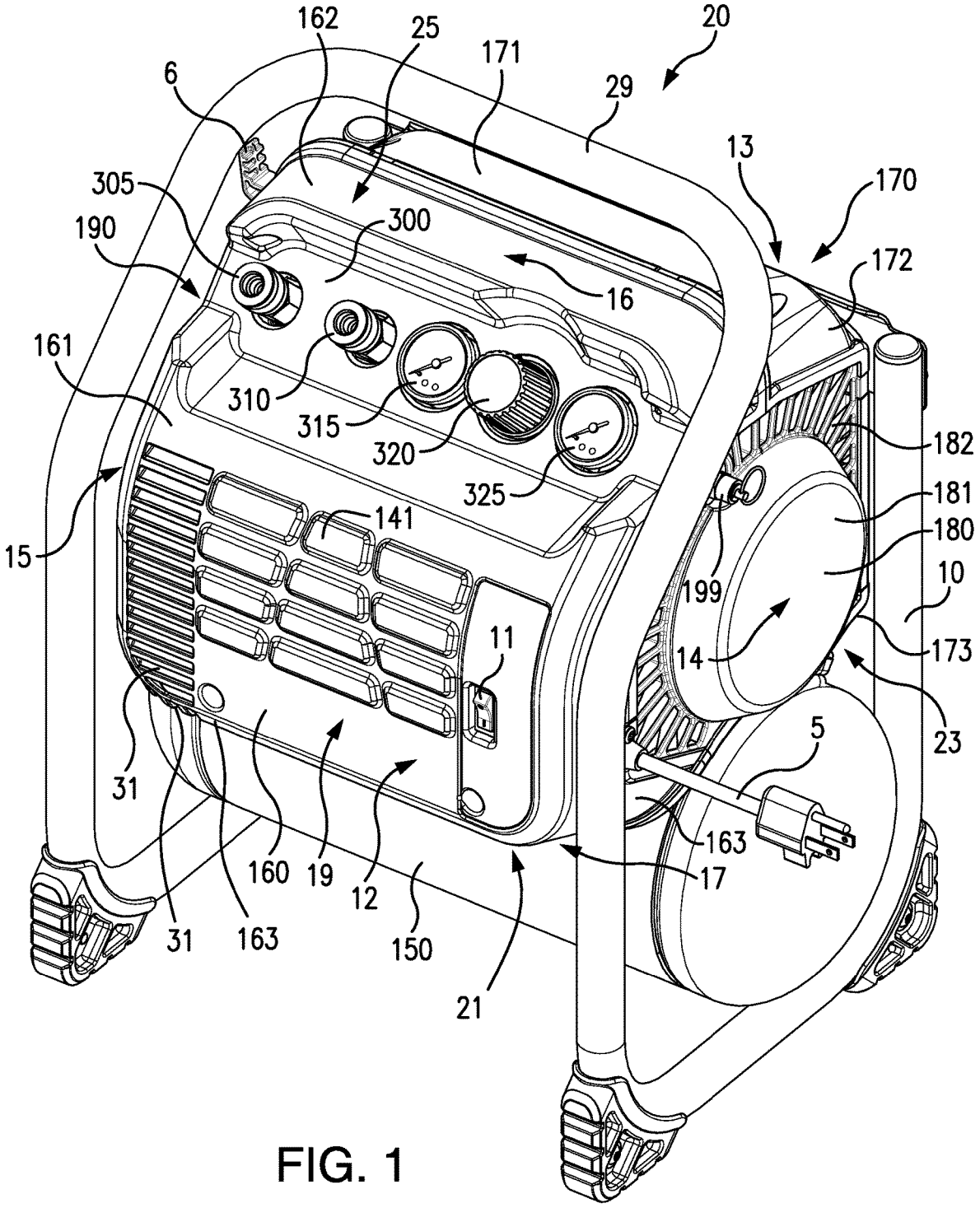
FIG. 1 is a perspective view of a compressor assembly.

FIG. 1 is a perspective view of a compressor assembly 20 shown according to the invention. In an embodiment, the compressor assembly 20 can compress air, or can compress one or more gases, or gas mixtures. In an embodiment, the compressor assembly 20 is also referred to hearing herein as "a gas compressor assembly" or "an air compressor assembly".

The compressor assembly 20 can optionally be portable. The compressor assembly 20 can optionally have a handle 29, which optionally can be a portion of frame 10.

In an embodiment, the compressor assembly 20 can have a value of weight between 15 lbs and 100 lbs. In an embodiment, the compressor assembly 20 can be portable and can have a value of weight between 15 lbs and 50 lbs. In an embodiment, the compressor assembly 20 can have a value of weight between 25 lbs and 40 lbs. In an embodiment, the compressor assembly 20 can have a value of weight of, e.g. 38 lbs, or 29 lbs, or 27 lbs, or 25 lbs, or 20 lbs, or less. In an embodiment, frame 10 can have a value of weight of 10 lbs or less. In an embodiment, frame 10 can weigh 5 lbs, or less, e.g. 4 lbs, or 3 lbs, of 2 lbs, or less.

In an embodiment, the compressor assembly 20 can have a front side 12 ("front"), a rear side 13 ("rear"), a fan side 14 ("fan-side"), a pump side 15 ("pump-side"), a top side 16 ("top") and a bottom side 17 ("bottom").

The compressor assembly 20 can have a housing 21 which can have ends and portions which are referenced herein by orientation consistently with the descriptions set forth above. In an embodiment, the housing 21 can have a front housing 160, a rear housing 170, a fan-side housing 180 and a pump-side housing 190. The front housing 160 can have a front housing portion 161, a top front housing portion 162 and a bottom front housing potion 163. The rear housing 170 can have a rear housing portion 171, a top rear housing portion 172 and a bottom rear housing portion 173. The fan-side housing 180 can have a fan cover 181 and a plurality of intake ports 182. The compressor assembly can be cooled by air flow provided by a fan 200 (FIG. 3), e.g. cooling air stream 2000 (FIG. 3).

In an embodiment, the housing 21 can be compact and can be molded. The housing 21 can have a construction at least in part of plastic, or polypropylene, acrylonitrile butadiene styrene (ABS), metal, steel, stamped steel, fiberglass, thermoset plastic, cured resin, carbon fiber, or other material. The frame 10 can be made of metal, steel, aluminum, carbon fiber, plastic or fiberglass.

Power can be supplied to the motor of the compressor assembly through a power cord 5 extending through the fan-side housing 180. In an embodiment, the compressor assembly 20 can comprise one or more of a cord holder member, e.g. first cord wrap 6 and second cord wrap 7 (FIG. 2).

In an embodiment, power switch 11 can be used to change the operating state of the compressor assembly 20 at least from an "on" to an "off" state, and vice versa. In an "on" state, the compressor can be in a compressing state (also herein as a "pumping state") in which it is compressing air, or a gas, or a plurality of gases, or a gas mixture.

Figure 7:
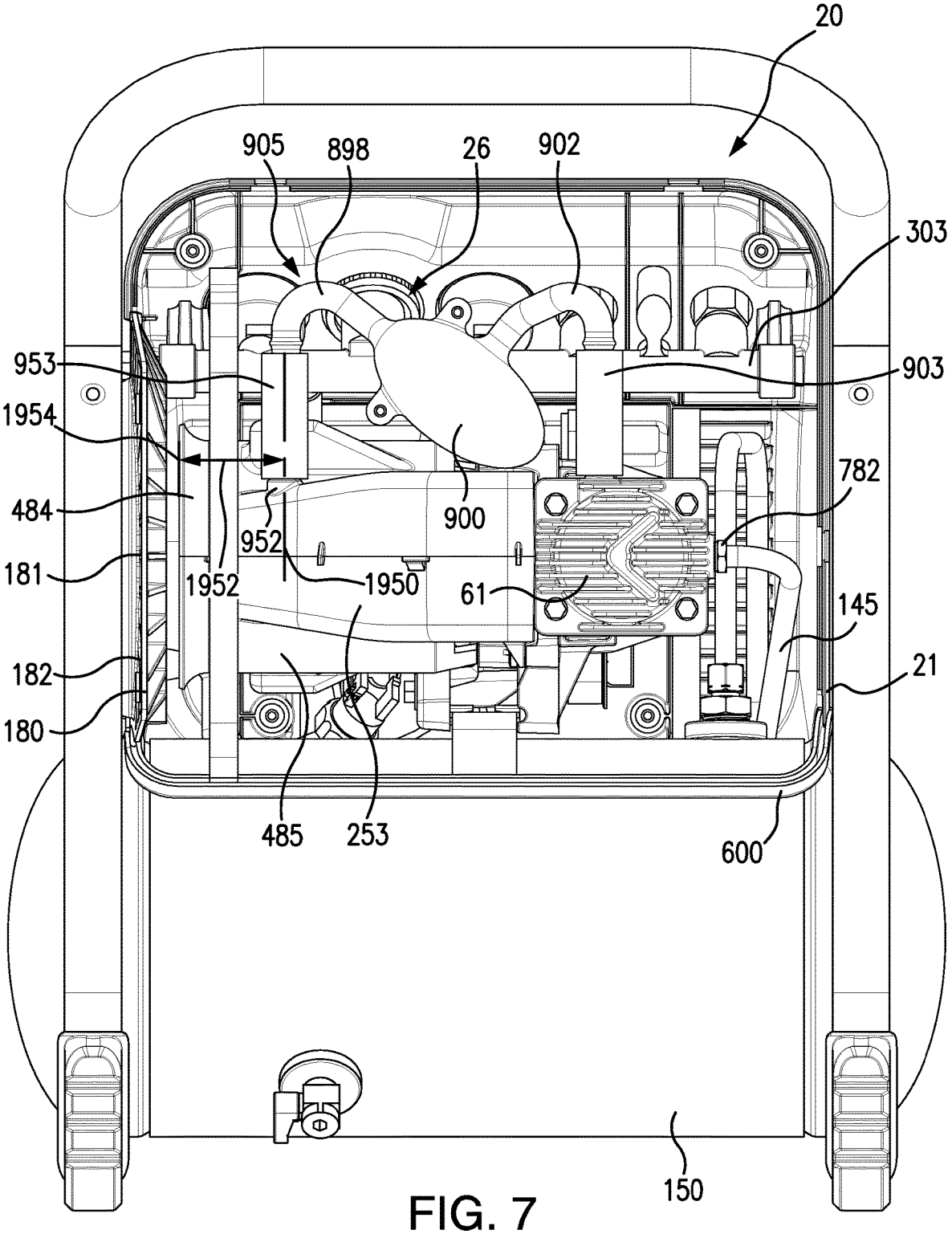
FIG. 7 is a rear view of internal components of the compressor assembly.

In an embodiment, other operating modes can be engaged by power switch 11 or a compressor control system, e.g. a standby mode, or a power save mode. In an embodiment, the front housing 160 can have a dashboard 300 which provides an operator-accessible location for connections, gauges and valves which can be connected to a manifold 303 (FIG. 7). In an embodiment, the dashboard 300 can provide an operator access in non-limiting example to a first quick connection 305, a second quick connection 310, a regulated pressure gauge 315, a pressure regulator 320 and a tank pressure gauge 325. In an embodiment, a compressed gas outlet line, hose or other device to receive compressed gas can be connected the first quick connection 305 and/or second quick connection 310. In an embodiment, as shown in FIG. 1, the frame can be configured to provide an amount of protection to the dashboard 300 from the impact of objects from at least the pump-side, fan-side and top directions.

In an embodiment, the pressure regulator 320 employs a pressure regulating valve. The pressure regulator 320 can be used to adjust the pressure regulating valve 26 (FIG. 7). The pressure regulating valve 26 can be set to establish a desired output pressure. In an embodiment, excess air pressure can be can vented to atmosphere through the pressure regulating valve 26 and/or pressure relief valve 199 (FIG. 1). In an embodiment, pressure relief valve 199 can be a spring loaded safety valve. In an embodiment, the air compressor assembly 20 can be designed to provide an unregulated compressed air output.

In an embodiment, the pump assembly 25 and the compressed gas tank 150 can be connected to frame 10. The pump assembly 25, housing 21 and compressed gas tank 150 can be connected to the frame 10 by a plurality of screws and/or one or a plurality of welds and/or a plurality of connectors and/or fasteners.

The plurality of intake ports 182 can be formed in the housing 21 adjacent the housing inlet end 23 and a plurality of exhaust ports 31 can be formed in the housing 21. In an embodiment, the plurality of the exhaust ports 31 can be placed in housing 21 in the front housing portion 161. Optionally, the exhaust ports 31 can be located adjacent to the pump end of housing 21 and/or the pump assembly 25 and/or the pump cylinder 60 and/or cylinder head 61 (FIG. 2) of the pump assembly 25. In an embodiment, the exhaust ports 31 can be provided in a portion of the front housing portion 161 and in a portion of the bottom front housing portion 163.

The total cross-sectional open area of the intake ports 182 (the sum of the cross-sectional areas of the individual intake ports 182) can be a value in a range of from 3.0 in^2 to 100 in^2. In an embodiment, the total cross-sectional open area of the intake ports 182 can be a value in a range of from 6.0 in^2 to 38.81 in^2. In an embodiment, the total cross-sectional open area of the intake ports 182 can be a value in a range of from 9.8 in^2 to 25.87 in^2. In an embodiment, the total cross-sectional open area of the intake ports 182 can be 12.936 in^2.

In an embodiment, the cooling gas employed to cool compressor assembly 20 and its components can be air (also known herein as "cooling air"). The cooling air can be taken in from the environment in which the compressor assembly 20 is placed. The cooling air can be ambient from the natural environment, or air which has been conditioned or treated. The definition of "air" herein is intended to be very broad. The term "air" includes breathable air, ambient air, treated air, conditioned air, clean room air, cooled air, heated air, non-flammable oxygen containing gas, filtered air, purified air, contaminated air, air with particulates solids or water, air from bone dry (i.e. 0.00 humidity) air to air which is supersaturated with water, as well as any other type of air present in an environment in which a gas (e.g. air) compressor can be used. It is intended that cooling gases which are not air are encompassed by this disclosure. For non-limiting example, a cooling gas can be nitrogen, can comprise a gas mixture, can comprise nitrogen, can comprise oxygen (in a safe concentration), can comprise carbon dioxide, can comprise one inert gas or a plurality of inert gases, or comprise a mixture of gases.

In an embodiment, cooling air can be exhausted from compressor assembly 20 through a plurality of exhaust ports 31. The total cross-sectional open area of the exhaust ports 31 (the sum of the cross-sectional areas of the individual exhaust ports 31) can be a value in a range of from 3.0 in^2 to 100 in^2. In an embodiment, the total cross-sectional open area of the exhaust ports can be a value in a range of from 3.0 in^2 to 77.62 in^2. In an embodiment, the total cross-sectional open area of the exhaust ports can be a value in a range of from 4.0 in^2 to 38.81 in^2. In an embodiment, the total cross-sectional open area of the exhaust ports can be a value in a range of from 4.91 in^2 to 25.87 in^2. In an embodiment, the total cross-sectional open area of the exhaust ports can be 7.238 in^2.

Numeric values and ranges herein, unless otherwise stated, also are intended to have associated with them a tolerance and to account for variances of design and manufacturing, and/or operational and performance fluctuations. Thus, a number disclosed herein is intended to disclose values "about" that number. For example, a value X is also intended to be understood as "about X". Likewise, a range of Y-Z is also intended to be understood as within a range of from "about Y-about Z". Unless otherwise stated, significant digits disclosed for a number are not intended to make the number an exact limiting value. Variance and tolerance, as well as operational or performance fluctuations, are an expected aspect of mechanical design and the numbers disclosed herein are intended to be construed to allow for such factors (in non-limiting e.g., ±10 percent of a given value). This disclosure is to be broadly construed. Likewise, the claims are to be broadly construed in their recitations of numbers and ranges.

The compressed gas tank 150 can operate at a value of pressure in a range of at least from ambient pressure, e.g. 14.7 psig to 3000 psig ("psig" is the unit lbf/in^2 gauge), or greater. In an embodiment, compressed gas tank 150 can operate at 200 psig. In an embodiment, compressed gas tank 150 can operate at 150 psig.

In an embodiment, the compressor has a pressure regulated on/off switch which can stop the pump when a set pressure is obtained. In an embodiment, the pump is activated when the pressure of the compressed gas tank 150 falls to 70 percent of the set operating pressure, e.g. to activate at 140 psig with an operating set pressure of 200 psig (140 psig=0.70*200 psig). In an embodiment, the pump is activated when the pressure of the compressed gas tank 150 falls to 80 percent of the set operating pressure, e.g. to activate at 160 psig with an operating set pressure of 200 psig (160 psig=0.80*200 psig). Activation of the pump can occur at a value of pressure in a wide range of set operating pressure, e.g. 25 percent to 99.5 percent of set operating pressure. Set operating pressure can also be a value in a wide range of pressure, e.g. a value in a range of from 25 psig to 3000 psig. An embodiment of set pressure can be 50 psig, 75 psig, 100 psig, 150 psig, 200 psig, 250 psig, 300 psig, 500 psig, 1000 psig, 2000 psig, 3000 psig, or greater than or less than, or a value in between these example numbers.

The compressor assembly 20 disclosed herein in its various embodiments achieves a reduction in the noise created by the vibration of the air tank while the air compressor is running, in its compressing state (pumping state) e.g. to a value in a range of from 60-75 dBA, or less, as measured by ISO3744-1995. Noise values discussed herein are compliant with ISO3744-1995 and the unit "dBA" as used herein is a unit of measurement of a sound pressure level. ISO3744-1995 is the standard for noise data and results for noise data, or sound data, provided in this application. Herein "noise" and "sound" are used synonymously.

The pump assembly 25 can be mounted to an air tank and can be covered with a housing 21. A plurality of optional decorative shapes 141 can be formed on the front housing portion 161. The plurality of optional decorative shapes 141 can also be sound absorbing and/or vibration dampening shapes. The plurality of optional decorative shapes 141 can optionally be used with, or contain at least in part, a sound absorbing material.

FIG. 2 is a front view of internal components of the compressor assembly.

The compressor assembly 20 can include a pump assembly 25. In an embodiment, pump assembly 25 which can compress a gas, air or gas mixture. In an embodiment in which the pump assembly 25 compresses air, it is also referred to herein as air compressor 25, or compressor 25. In an embodiment, the pump assembly 25 can be powered by a motor 33 (e.g. FIG. 3).

FIG. 2 illustrates the compressor assembly 20 with a portion of the housing 21 removed and showing the pump assembly 25. In an embodiment, the fan-side housing 180 can have a fan cover 181 and a plurality of intake ports 182. The cooling gas, for example air, can be fed through an air inlet space 184 which feeds air into the fan 200 (e.g. FIG. 3). In an embodiment, the fan 200 can be housed proximate to an air intake port 186 of an air ducting shroud 485.

Air ducting shroud 485 can have a shroud inlet scoop 484. As illustrated in FIG. 2, air ducting shroud 485 is shown encasing the fan 200 and the motor 33 (FIG. 3). In an embodiment, the shroud inlet scoop 484 can encase the fan 200, or at least a portion of the fan and at least a portion of motor 33. In this embodiment, an air inlet space 184 which feeds air into the fan 200 is shown. The air ducting shroud 485 can encase the fan 200 and the motor 33, or at least a portion of these components.

FIG. 2 is an intake muffler 900 which can receive feed air for compression (also herein as "feed air 990"; e.g. FIG. 8) via the intake muffler feed line 898. The feed air 990 can pass through the intake muffler 900 and be fed to the cylinder head 61 via the muffler outlet line 902. The feed air 990 can be compressed in pump cylinder 60 by piston 63. The piston can be provided with a seal which can function, such as slide, in the cylinder without liquid lubrication. The cylinder head 61 can be shaped to define an inlet chamber 81 (e.g. FIG. 9) and an outlet chamber 82 (e.g. FIG. 8) for a compressed gas, such as air (also known herein as "compressed air 999" or "compressed gas 999"; e.g. FIG. 10). In an embodiment, the pump cylinder 60 can be used as at least a portion of an inlet chamber 81. A gasket can form an air tight seal between the cylinder head 61 and the valve plate assembly 62 to prevent a leakage of a high pressure gas, such as compressed air 999, from the outlet chamber 82. Compressed air 999 can exit the cylinder head 61 via a compressed gas outlet port 782 and can pass through a compressed gas outlet line 145 to enter the compressed gas tank 150.

Figure 9:
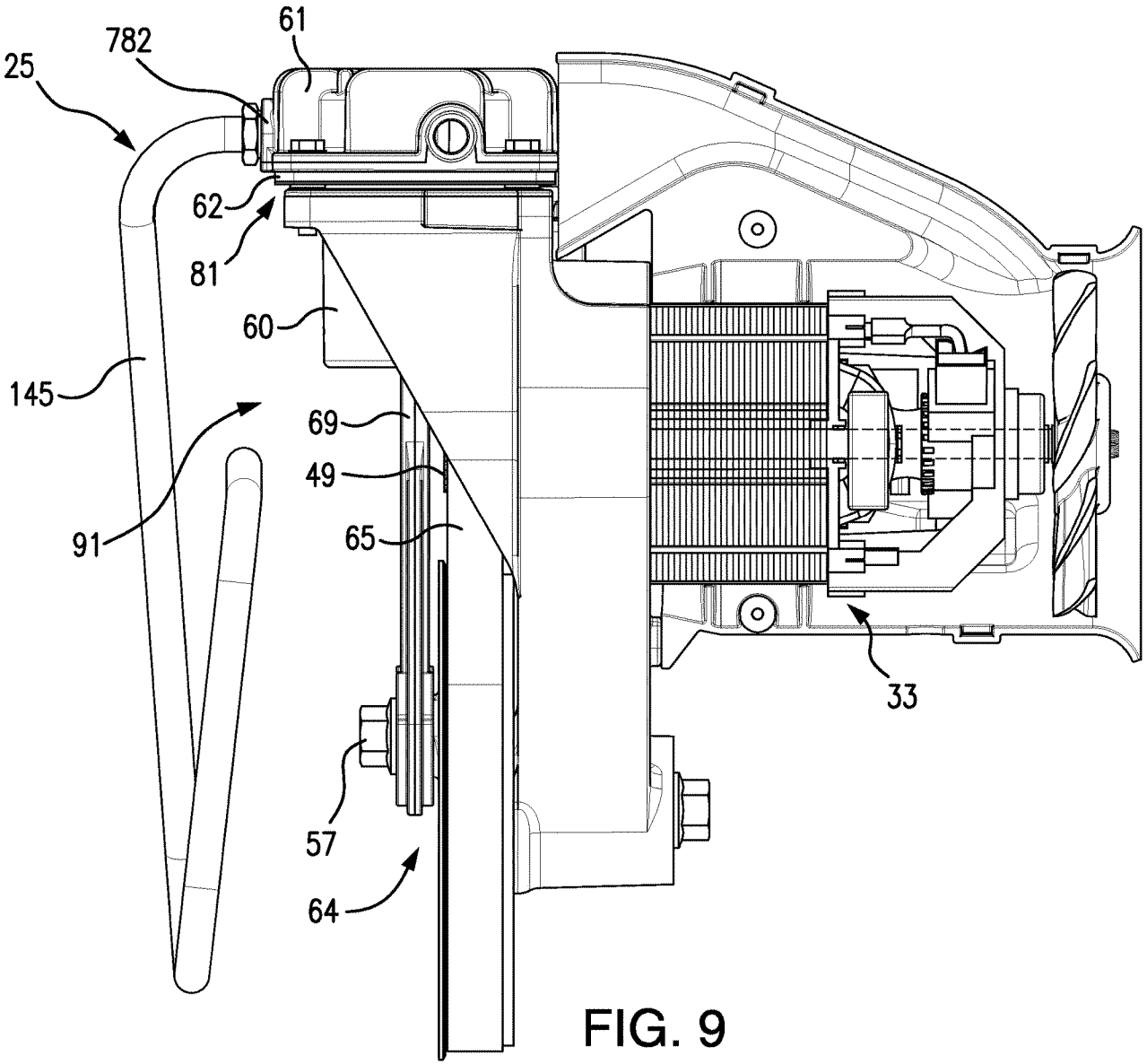
FIG. 9 is a top view of components of the pump assembly.

As shown in FIG. 2, the pump assembly 25 can have a pump cylinder 60, a cylinder head 61, a valve plate assembly 62 mounted between the pump cylinder 60 and the cylinder head 61, and a piston 63 which is reciprocated in the pump cylinder 60 by an eccentric drive 64 (e.g. FIG. 9). The eccentric drive 64 can include a sprocket 49 which can drive a drive belt 65 which can drive a pulley 66. A bearing 67 can be eccentrically secured to the pulley 66 by a screw, or a rod bolt 57, and a connecting rod 69. Preferably, the sprocket 49 and the pulley 66 can be spaced around their perimeters and the drive belt 65 can be a timing belt. The pulley 66 can be mounted about pulley centerline 887 and linked to a sprocket 49 by the drive belt 65 (FIG. 3) which can be configured on an axis which is represent herein as a shaft centerline 886 supported by a bracket and by a bearing 47 (FIG. 3). A bearing can allow the pulley 66 to be rotated about an axis 887 (FIG. 10) when the motor rotates the sprocket 49. As the pulley 66 rotates about the axis 887 (FIG. 10), the bearing 67 (FIG. 2) and an attached end of the connecting rod 69 are moved around a circular path.

The piston 63 can be formed as an integral part of the connecting rod 69. A compression seal can be attached to the piston 63 by a retaining ring and a screw. In an embodiment, the compression seal can be a sliding compression seal.

A cooling gas stream, such as cooling air stream 2000 (FIG. 3), can be drawn through intake ports 182 to feed fan 200. The cooling air stream 2000 can be divided into a number of different cooling air stream flows which can pass through portions of the compressor assembly and exit separately, or collectively as an exhaust air steam through the plurality of exhaust ports 31. Additionally, the cooling gas, e.g. cooling air stream 2000, can be drawn through the plurality of intake ports 182 and directed to cool the internal components of the compressor assembly 20 in a predetermined sequence to optimize the efficiency and operating life of the compressor assembly 20. The cooling air can be heated by heat transfer from compressor assembly 20 and/or the components thereof, e.g. pump assembly 25 (FIG. 3). The heated air can be exhausted through the plurality of exhaust ports 31.

In an embodiment, one fan can be used to cool both the pump and motor. A design using a single fan to provide cooling to both the pump and motor can require less air flow than a design using two or more fans, e.g. using one or more fans to cool the pump, and also using one or more fans to cool the motor. Using a single fan to provide cooling to both the pump and motor can reduce power requirements and also reduces noise production as compared to designs using a plurality of fans to cool the pump and the motor, or which use a plurality of fans to cool the pump assembly 25, or the compressor assembly 20.

In an embodiment, the fan blade 205 (e.g. FIG. 3) establishes a forced flow of cooling air through the internal housing, such as the air ducting shroud 485. The cooling air flow through the air ducting shroud can be a volumetric flow rate having a value of between 25 CFM to 400 CFM. The cooling air flow through the air ducting shroud can be a volumetric flow rate having a value of between 45 CFM to 125 CFM.

In an embodiment, the outlet pressure of cooling air from the fan can be in a range of from 1 psig to 50 psig. In an embodiment, the fan 200 can be a low flow fan with which generates an outlet pressure having a value in a range of from 1 in of water to 10 psi. In an embodiment, the fan 200 can be a low flow fan with which generates an outlet pressure having a value in a range of from 2 in of water to 5 psi.

In an embodiment, the air ducting shroud 485 can flow 100 CFM of cooling air with a pressure drop of from 0.0002 psi to 50 psi along the length of the air ducting shroud. In an embodiment, the air ducting shroud 485 can flow 75 CFM of cooling air with a pressure drop of 0.028 psi along its length as measured from the entrance to fan 200 through the exit from conduit 253 (FIG. 7).

In an embodiment, the air ducting shroud 485 can flow 75 CFM of cooling air with a pressure drop of 0.1 psi along its length as measured from the outlet of fan 200 through the exit from conduit 253. In an embodiment, the air ducting shroud 485 can flow 100 CFM of cooling air with a pressure drop of 1.5 psi along its length as measured from the outlet of fan 200 through the exit from conduit 253. In an embodiment, the air ducting shroud 485 can flow 150 CFM of cooling air with a pressure drop of 5.0 psi along its length as measured from the outlet of fan 200 through the exit from conduit 253.

In an embodiment, the air ducting shroud 485 can flow 75 CFM of cooling air with a pressure drop in a range of from 1.0 psi to 30 psi across as measured from the outlet of fan 200 across the motor 33.

Depending upon the compressed gas (e.g. compressed air 999) output, the design rating of the motor 33 and the operating voltage, in an embodiment the motor 33 can operate at a value of rotation (motor speed) between 5,000 rpm and 20,000 rpm. In an embodiment, the motor 33 can operate at a value in a range of between 7,500 rpm and 12,000 rpm. In an embodiment, the motor 33 can operate at e.g. 11,252 rpm, or 11,000 rpm; or 10,000 rpm; or 9,000 rpm; or 7,500; or 6,000 rpm; or 5,000 rpm. The pulley 66 and the sprocket 49 can be sized to achieve reduced pump speeds (also herein as "reciprocation rates", or "piston speed") at which the piston 63 is reciprocated. For example, if the sprocket 49 can have a diameter of 1 in and the pulley 66 can have a diameter of 4 in, then a motor 33 speed of 14,000 rpm can achieve a reciprocation rate, or a piston speed, of 3,500 strokes per minute. In an embodiment, if the sprocket 49 can have a diameter of 1.053 in and the pulley 66 can have a diameter of 5.151 in, then a motor 33 speed of 11,252 rpm can achieve a reciprocation rate, or a piston speed (pump speed), of 2,300 strokes per minute.

FIG. 3 is a front sectional view of the motor and fan assembly.

FIG. 3 illustrates the fan 200 and motor 33 covered by air ducting shroud 485. The fan 200 is shown proximate to a shroud inlet scoop 484.

The motor can have a stator 37 with an upper pole 38 around which upper stator coil 40 is wound and/or configured. The motor can have a stator 37 with a lower pole 39 around which lower stator coil 41 is wound and/or configured. A shaft 43 can be supported adjacent a first shaft end 44 by a bearing 45 and is supported adjacent to a second shaft end 46 by a bearing 47. A plurality of fan blades 205 can be secured to the fan 200 which can be secured to the first shaft end 44. When power is applied to the motor 33, the shaft 43 rotates at a high speed to in turn drive the sprocket 49 (FIG. 2), the drive belt 65 (FIG. 4), the pulley 66 (FIG. 4) and the fan blade 200. In an embodiment, the motor can be a non-synchronous universal motor. In an embodiment, the motor can be a synchronous motor used.

The compressor assembly 20 can be designed to accommodate a variety of types of motor 33. The motors 33 can come from different manufacturers and can have horsepower ratings of a value in a wide range from small to very high. In an embodiment, a motor 33 can be purchased from the existing market of commercial motors. For example, although the housing 21 is compact, in an embodiment it can accommodate a universal motor, or other motor type, rated, for example, at ½ horsepower, at ¾ horsepower or 1 horsepower by scaling and/or designing the air ducting shroud 485 to accommodate motors in a range from small to very large.

FIG. 3 and FIG. 4 illustrate the compression system for the compressor which is also referred to herein as the pump assembly 25. The pump assembly 25 can have a pump 59, a pulley 66, drive belt 65 and driving mechanism driven by motor 33. The connecting rod 69 can connect to a piston 63 (e.g. FIG. 10) which can move inside of the pump cylinder 60.

In one embodiment, the pump 59 such as "gas pump" or "air pump" can have a piston 63, a pump cylinder 60, in which a piston 63 reciprocates and a cylinder rod 69 (FIG. 2) which can optionally be oil-less and which can be driven to compress a gas, e.g. air. The pump 59 can be driven by a high speed universal motor, e.g. motor 33 (FIG. 3), or other type of motor.

FIG. 4 is a pump-side view of components of the pump assembly 25. The "pump assembly 25" can have the components which are attached to the motor and/or which serve to compress a gas; which in non-limiting example can comprise the fan, the motor 33, the pump cylinder 60 and piston 63 (and its driving parts), the valve plate assembly 62, the cylinder head 61 and the outlet of the cylinder head 782. Herein, the feed air system 905 system (FIG. 7) is referred to separately from the pump assembly 25.

FIG. 4 illustrates that pulley 66 is driven by the motor 33 using drive belt 65.

FIG. 4 (also see FIG. 10) illustrates an offset 880 which has a value of distance which represents one half (½) of the stroke distance. The offset 880 can have a value between 0.25 in and 6 in, or larger. In an embodiment, the offset 880 can have a value between 0.75 in and 3 in. In an embodiment, the offset 880 can have a value between 1.0 in and 2 in, e.g. 1.25 in. In an embodiment, the offset 880 can have a value of about 0.796 in. In an embodiment, the offset 880 can have a value of about 0.5 in. In an embodiment, the offset 880 can have a value of about 1.5 in.

A stroke having a value in a range of from 0.50 in and 12 in, or larger can be used. A stroke having a value in a range of from 1.5 in and 6 in can be used. A stroke having a value in a range of from 2 in and 4 in can be used. A stroke of 2.5 in can be used. In an embodiment, the stroke can be calculated to equal two (2) times the offset, for example, an offset 880 of 0.796 produces a stroke of 2(0.796)=1.592 in. In another example, an offset 880 of 2.25 produces a stroke of 2(2.25)=4.5 in. In yet another example, an offset 880 of 0.5 produces a stroke of 2(0.5)=1.0 in.

The compressed air passes through valve plate assembly 62 and into the cylinder head 61 having a plurality of cooling fins 89. The compressed gas, is discharged from the cylinder head 61 through the outlet line 145 which feeds compressed gas to the compressed gas tank 150.

FIG. 4 also identifies the pump-side of upper motor path 268 which can provide cooling air to upper stator coil 40 and lower motor path 278 which can provide cooling to lower stator coil 41.

Figure 5:
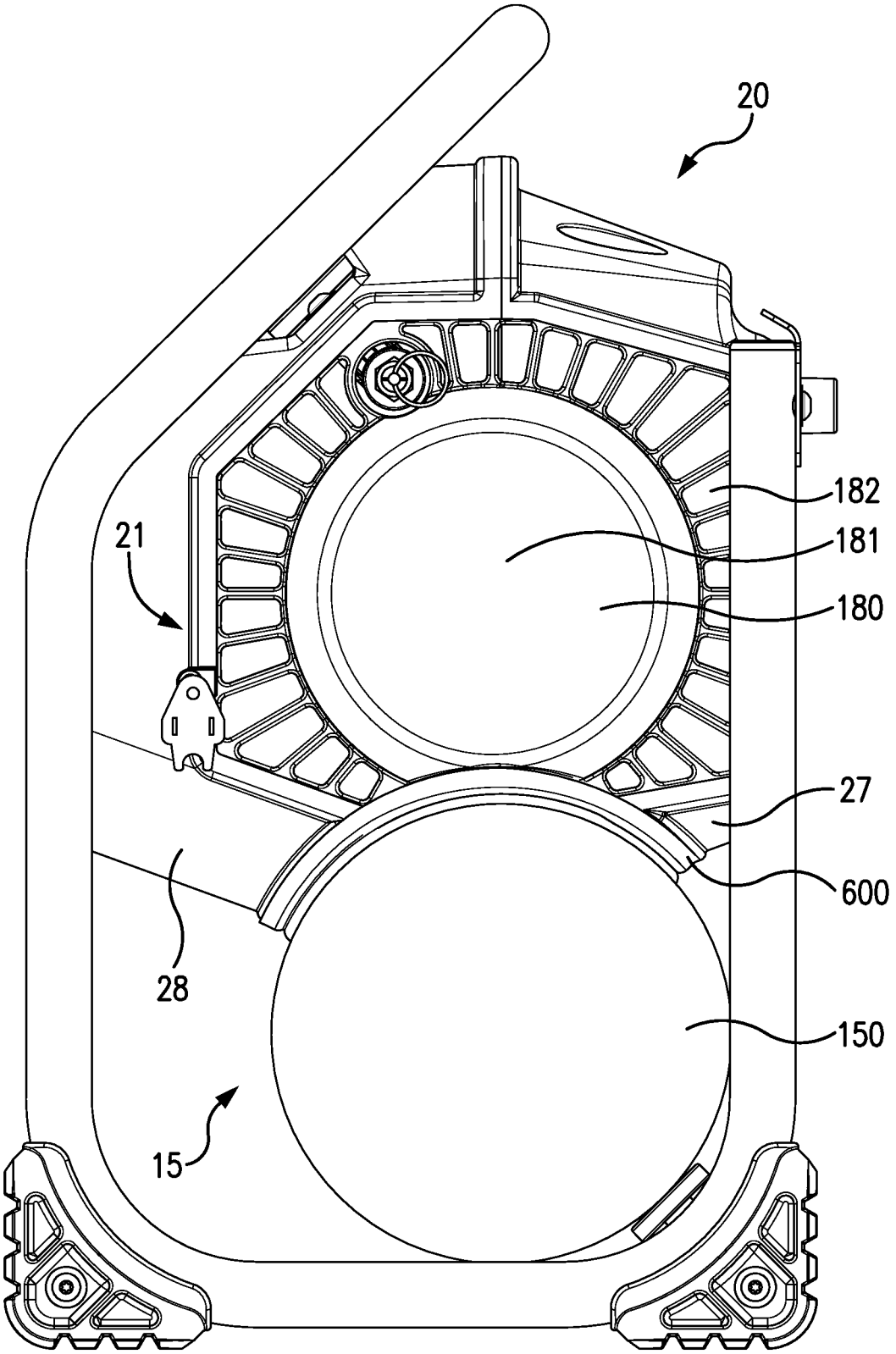
FIG. 5 is a fan-side perspective of the compressor assembly.

FIG. 5 illustrates tank seal 600 providing a seal between the housing 21 and compressed gas tank 150 viewed from fan-side 14. FIG. 5 is a fan-side perspective of the compressor assembly 20. FIG. 5 illustrates a fan-side housing 180 having a fan cover 181 with intake ports 182. FIG. 5 also shows a fan-side view of the compressed gas tank 150. Tank seal 600 is illustrated sealing the housing 21 to the compressed gas tank 150. Tank seal 600 can be a one piece member or can have a plurality of segments which form tank seal 600.

Figure 6:
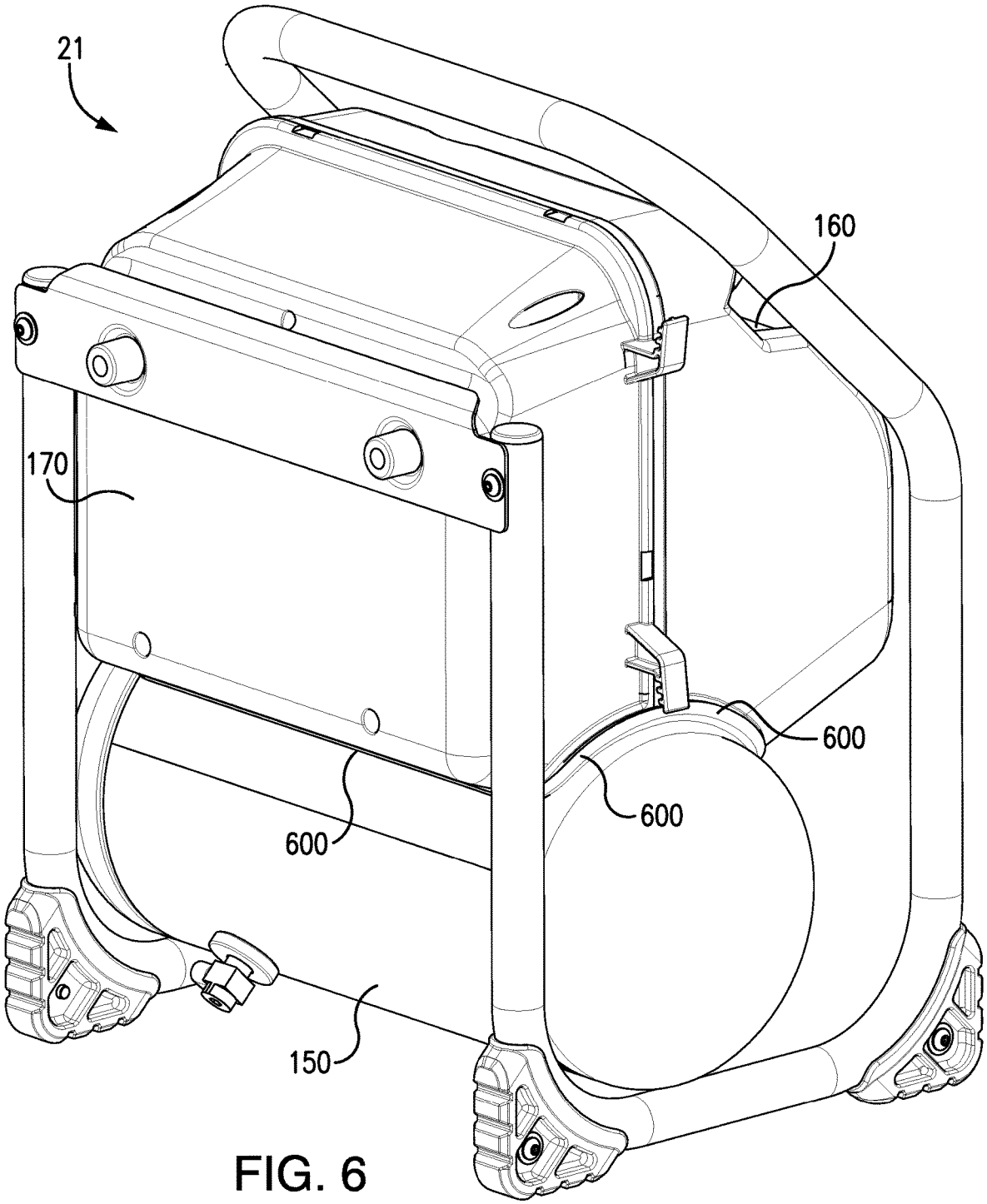
FIG. 6 is a rear perspective of the compressor assembly.

FIG. 6 is a rear-side perspective of the compressor assembly 20. FIG. 6 illustrates a tank seal 600 sealing the housing 21 to the compressed gas tank 150.

FIG. 7 is a rear view of internal components of the compressor assembly. In this sectional view, in which the rear housing 170 is not shown, the fan-side housing 180 has a fan cover 181 and intake ports 182. The fan-side housing 180 is configured to feed air to air ducting shroud 485. Air ducting shroud 485 has shroud inlet scoop 484 and conduit 253 which can feed a cooling gas, such as air, to the cylinder head 61 and pump cylinder 60.

Figure 8:
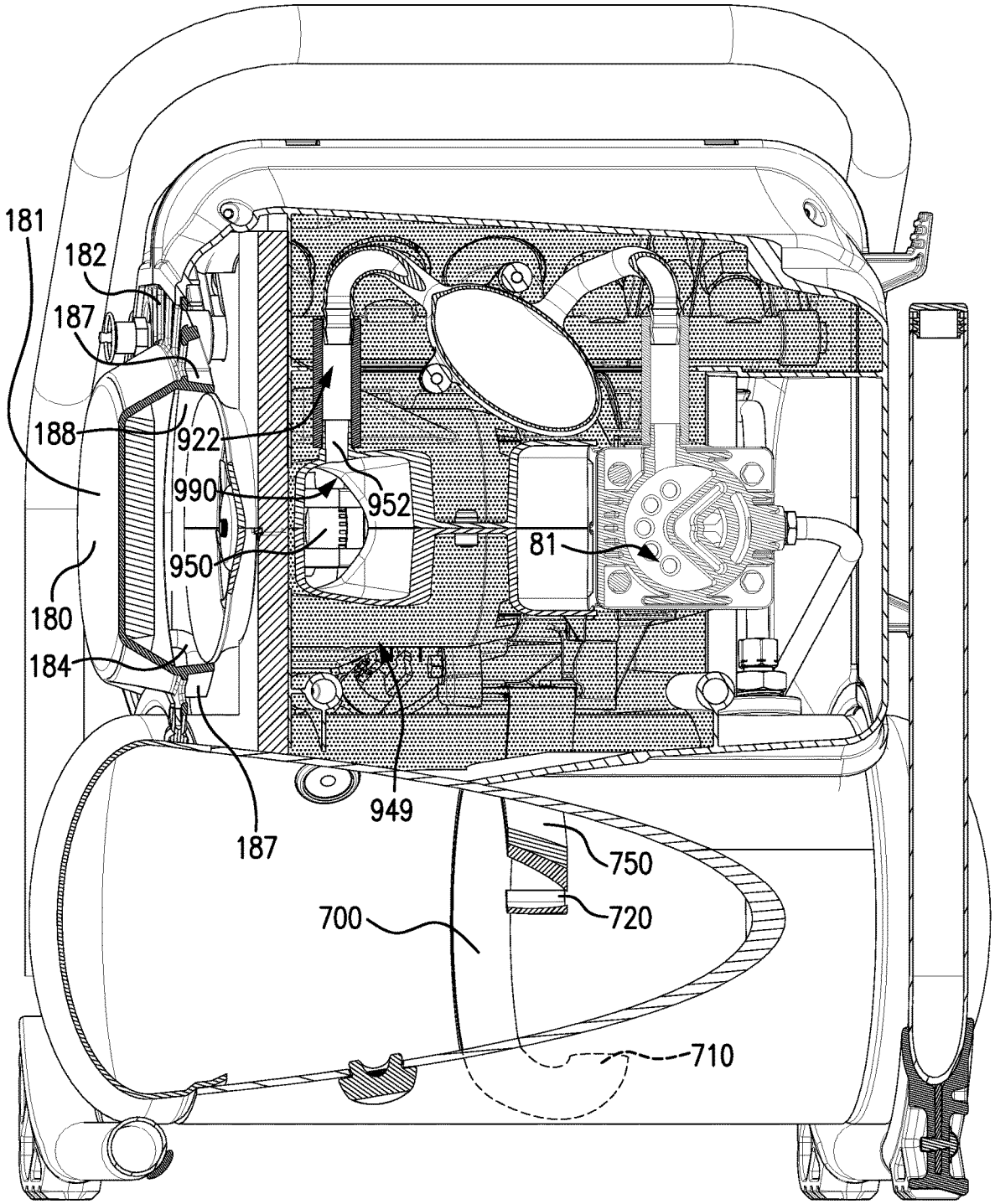
FIG. 8 is a rear sectional view of the compressor assembly.

FIG. 7 also provides a view of the feed air system 905. The feed air system 905 can feed a feed air 990 through a feed air port 952 for compression in the pump cylinder 60 of pump assembly 25. The feed air port 952 can optionally receive a clean air feed from an inertia filter 949 (FIG. 8). The clean air feed can pass through the feed air port 952 to flow through an air intake hose 953 and an intake muffler feed line 898 to the intake muffler 900. The clean air can flow from the intake muffler 900 through muffler outlet line 902 and cylinder head hose 903 to feed pump cylinder head 61. Noise can be generated by the compressor pump, such as when the piston forces air in and out of the valves of valve plate assembly 62. The intake side of the pump can provide a path for the noise to escape from the compressor which intake muffler 900 can serve to muffle.

The filter distance 1952 between an inlet centerline 1950 of the feed air port 952 and a scoop inlet 1954 of shroud inlet scoop 484 can vary widely and have a value in a range of from 0.5 in to 24 in, or even greater for larger compressor assemblies. The filter distance 1952 between inlet centerline 1950 and inlet cross-section of shroud inlet scoop 484 identified as scoop inlet 1954 can be e.g. 0.5 in, or 1.0 in, or 1.5 in, or 2.0 in, or 2.5 in, or 3.0 in, or 4.0 in, or 5.0 in or 6.0 in, or greater. In an embodiment, the filter distance 1952 between inlet centerline 1950 and inlet cross-section of shroud inlet scoop 484 identified as scoop inlet 1954 can be 1.859 in. In an embodiment, the inertia filter can have multiple inlet ports which can be located at different locations of the air ducting shroud 485. In an embodiment, the inertial filter is separate from the air ducting shroud and its feed is derived from one or more inlet ports.

FIG. 7 illustrates that compressed air can exit the cylinder head 61 via the compressed gas outlet port 782 and pass through the compressed gas outlet line 145 to enter the compressed gas tank 150. FIG. 7 also shows a rear-side view of manifold 303.

FIG. 8 is a rear sectional view of the compressor assembly 20. FIG. 8 illustrates the fan cover 181 having a plurality of intake ports 182. A portion of the fan cover 181 can be extended toward the shroud inlet scoop 484, e.g. the rim 187. In this embodiment, the fan cover 181 has a rim 187 which can eliminate a visible line of sight to the air inlet space 184 from outside of the housing 21. In an embodiment, the rim 187 can cover or overlap an air space 188. FIG. 8 illustrates an inertia filter 949 having an inertia filter chamber 950 and air intake path 922.

In an embodiment, the rim 187 can extend past the air inlet space 184 and overlaps at least a portion of the shroud inlet scoop 484. In an embodiment, the rim 187 does not extend past and does not overlap a portion of the shroud inlet scoop 484 and the air inlet space 184 can have a width between the rim 187 and a portion of the shroud inlet scoop 484 having a value of distance in a range of from 0.1 in to 2 in, e.g. 0.25 in, or 0.5 in. In an embodiment, the air ducting shroud 485 and/or the shroud inlet scoop 484 can be used to block line of sight to the fan 200 and the pump assembly 25 in conjunction with or instead of the rim 187.

The inertia filter 949 can provide advantages over the use of a filter media which can become plugged with dirt and/or particles and which can require replacement to prevent degrading of compressor performance. Additionally, filter media, even when it is new, creates a pressure drop and can reduce compressor performance.

Air must make a substantial change in direction from the flow of cooling air to become compressed gas feed air to enter and pass through the feed air port 952 to enter the air intake path 922 from the inertia filter chamber 950 of the inertia filter 949. Any dust and other particles dispersed in the flow of cooling air have sufficient inertia that they tend to continue moving with the cooling air rather than change direction and enter the air intake path 922.

FIG. 8 also shows a section of a dampening ring 700. The dampening ring 700 can optionally have a cushion member 750, as well as optionally a first hook 710 and a second hook 720.

FIG. 9 is a top view of the components of the pump assembly 25.

Pump assembly 25 can have a motor 33 which can drive the shaft 43 which causes a sprocket 49 to drive a drive belt 65 to rotate a pulley 66. The pulley 66 can be connected to and can drive the connecting rod 69 which has a piston 63 (FIG. 2) at an end. The piston 63 can compress a gas in the pump cylinder 60 pumping the compressed gas through the valve plate assembly 62 into the cylinder head 61 and then out through a compressed gas outlet port 782 through an outlet line 145 and into the compressed gas tank 150.

FIG. 9 also shows a pump 91. Herein, pump 91 collectively refers to a combination of parts including the cylinder head 61, the pump cylinder 60, the piston 63 and the connecting rod having the piston 63, as well as the components of these parts.

Figure 10:
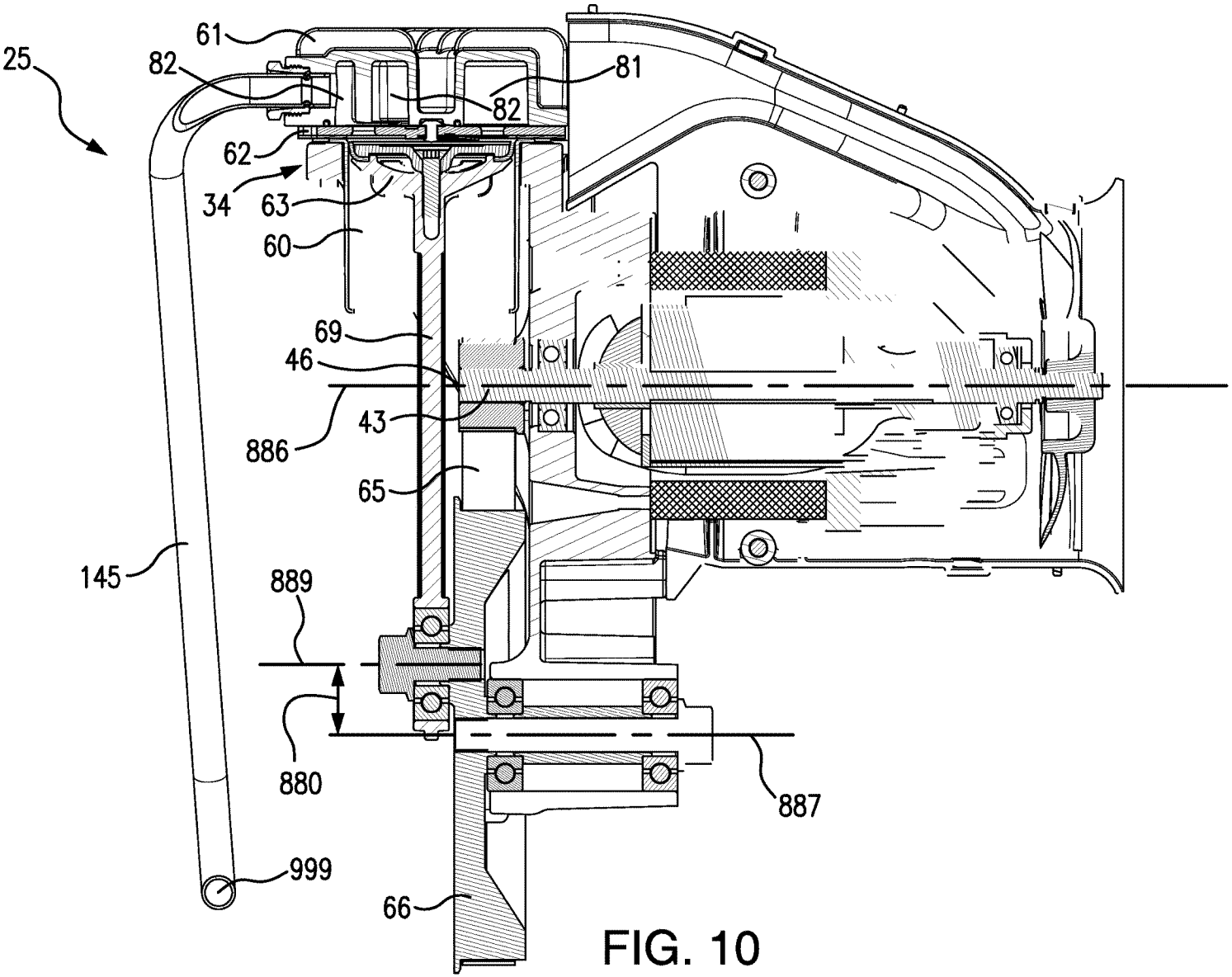
FIG. 10 is a top sectional view of the pump assembly.

FIG. 10 is a top sectional view of the pump assembly 25. FIG. 10 also shows a shaft centerline 886, as well as pulley centerline 887 and a rod bolt centerline 889 of a rod bolt 57. FIG. 10 illustrates an offset 880 which can be a dimension having a value in the range of 0.5 in to 12 in, or greater. In an embodiment, the stroke can be 1.592 in, from an offset 880 of 0.796 in. FIG. 10 also shows air inlet chamber 81.

Figure 11:
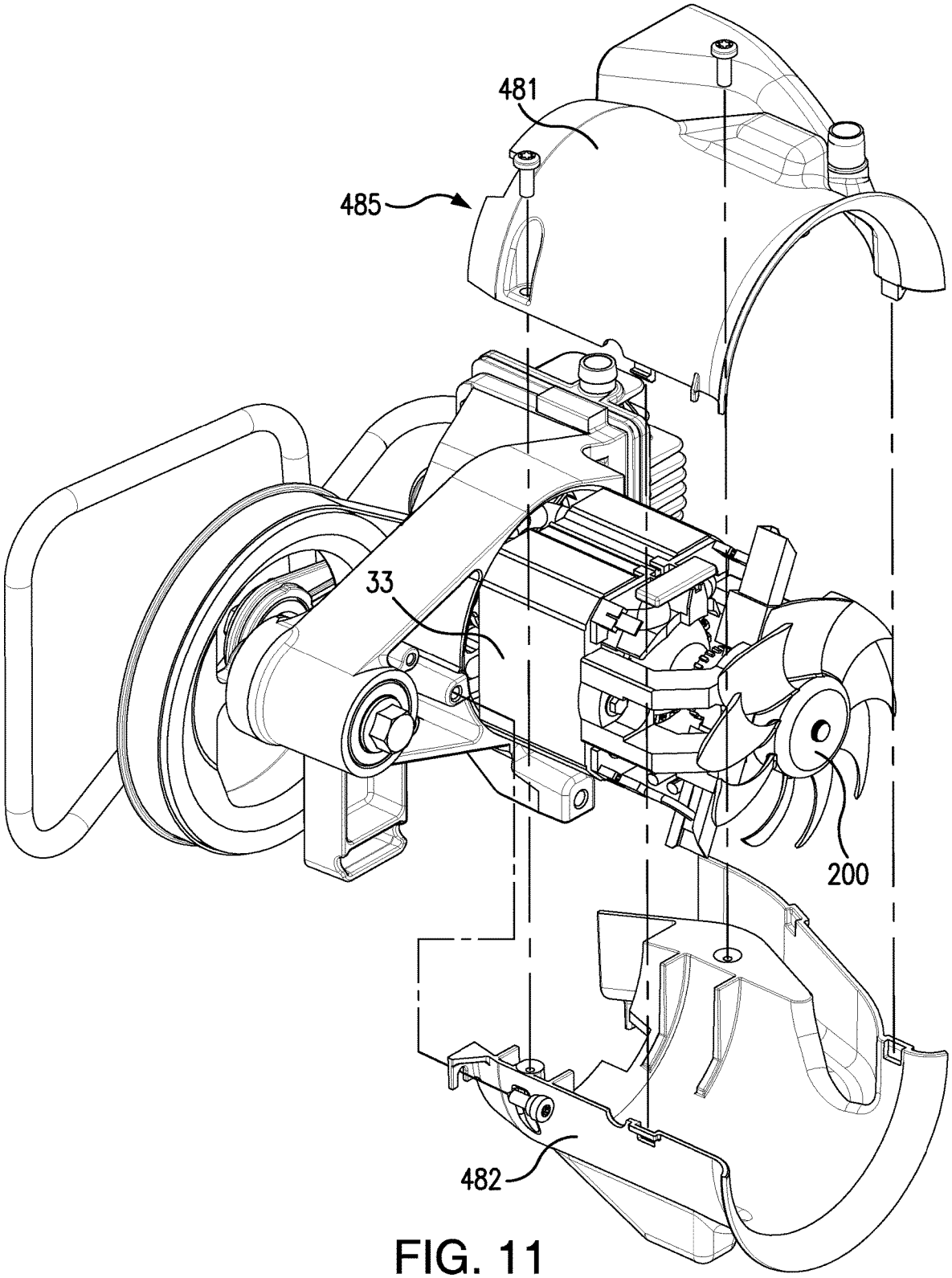
FIG. 11 is an exploded view of the air ducting shroud.

FIG. 11 illustrates an exploded view of the air ducting shroud 485. In an embodiment, the air ducting shroud 485 can have an upper ducting shroud 481 and a lower ducting shroud 482. In the example of FIG. 11, the upper ducting shroud 481 and the lower ducting shroud 482 can be fit together to shroud the fan 200 and the motor 33 and can create air ducts for cooling pump assembly 25 and/or the compressor assembly 20. In an embodiment, the air ducting shroud 485 can also be a motor cover for motor 33. The upper air ducting shroud 481 and the lower air ducting shroud 482 can be connected by a broad variety of means which can include snaps and/or screws.

Figure 12:
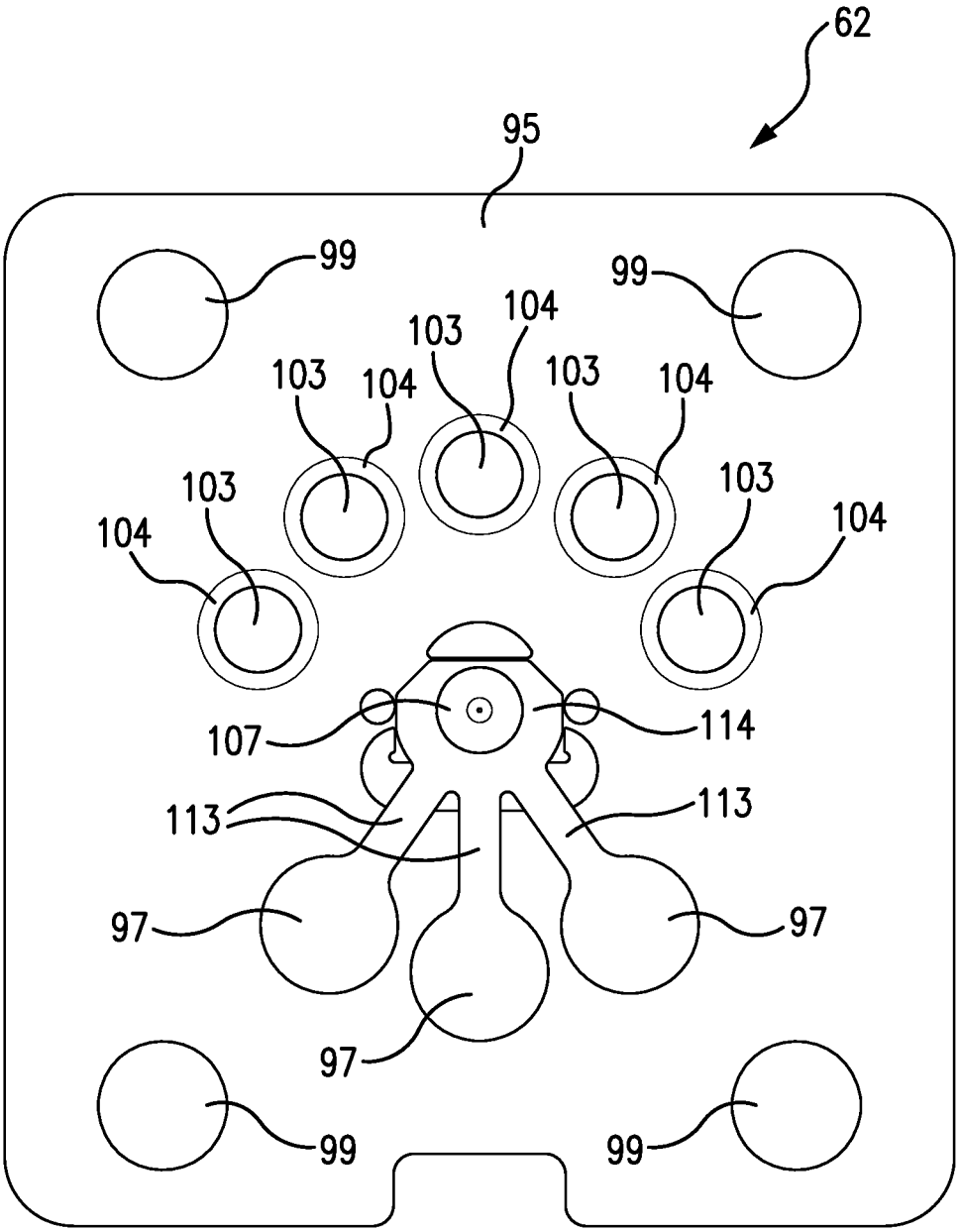
FIG. 12 is a rear view of a valve plate assembly.

FIG. 12 is a rear-side view of a valve plate assembly. A valve plate assembly 62 is shown in detail in FIGS. 12, 13 and 14.

The valve plate assembly 62 of the pump assembly 25 can include air intake and air exhaust valves. The valves can be of a reed, flapper, one-way or other type. A restrictor can be attached to the valve plate adjacent the intake valve. Deflection of the exhaust valve can be restricted by the shape of the cylinder head which can minimize valve impact vibrations and corresponding valve stress.

Figure 13:
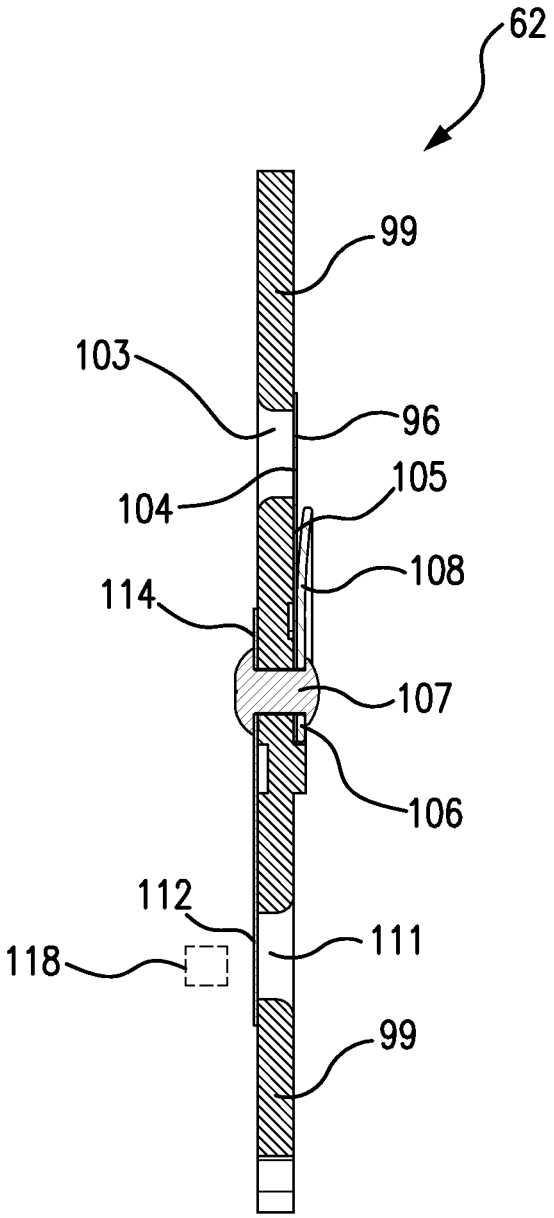
FIG. 13 is a cross-sectional view of the valve plate assembly.
Figure 14:
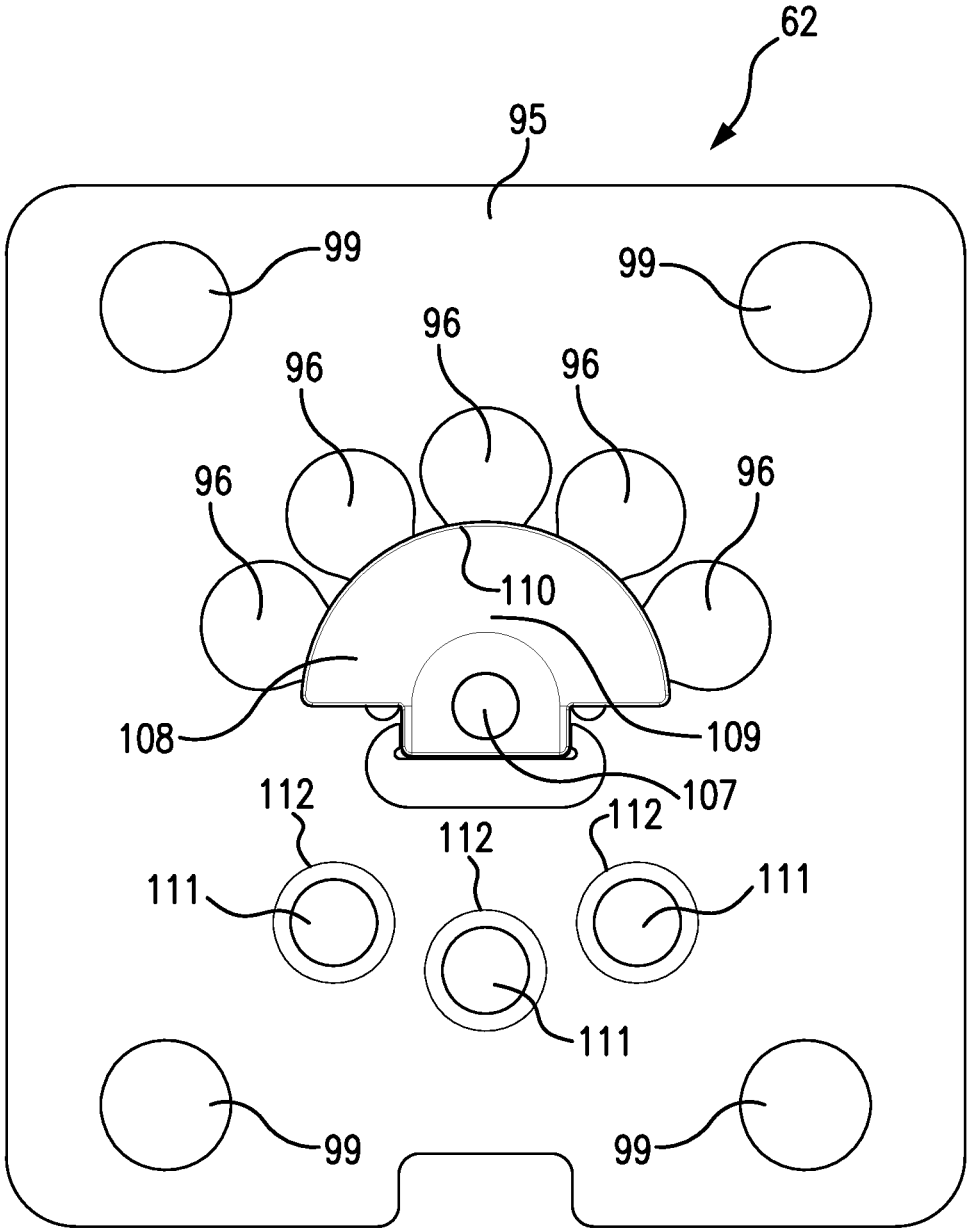
FIG. 14 is a front view of the valve plate assembly.

The valve plate assembly 62 has a plurality of intake ports 103 (five shown) which can be closed by the intake valves 96 (FIG. 14) which can extend from fingers 105 (FIG. 13). In an embodiment, the intake valves 96 can be of the reed or "flapper" type and are formed, for example, from a thin sheet of resilient stainless steel. Radial fingers 113 (FIG. 12) can radiate from a valve finger hub 114 to connect the plurality of valve members 104 of intake valves 96 and to function as return springs. A rivet 107 secures the hub 106 (e.g. FIG. 13) to the center of the valve plate 95. An intake valve restrictor 108 can be clamped between the rivet 107 and the hub 106. The surface 109 terminates at an edge 110 (FIGS. 13 and 14). When air is drawn into the pump cylinder 60 during an intake stroke of the piston 63, the radial fingers 113 can bend and the plurality of valve members 104 separate from the valve plate assembly 62 to allow air to flow through the intake ports 103.

FIG. 13 is a cross-sectional view of the valve plate assembly and FIG. 14 is a front-side view of the valve plate assembly. The valve plate assembly 62 includes a valve plate 95 which can be generally flat and which can mount a plurality of intake valves 96 (FIG. 14) and a plurality of outlet valves 97 (FIG. 12). In an embodiment, the valve plate assembly 62 (FIGS. 10 and 12) can be clamped to a bracket by screws which can pass through the cylinder head 61 (e.g. FIG. 2), the gasket and a plurality of through holes 99 in the valve plate assembly 62 and engage a bracket. A valve member 112 of the outlet valve 97 can cover an exhaust port 111. A cylinder flange and a gas tight seal can be used in closing the cylinder head assembly. In an embodiment, a flange and seal can be on a cylinder side (herein front-side) of a valve plate assembly 62 and a gasket can be between the valve plate assembly 62 and the cylinder head 61.

FIG. 14 illustrates the front side of the valve plate assembly 62 which can have a plurality of exhaust ports 111 (three shown) which are normally closed by the outlet valves 97. A plurality of a separate circular valve member 112 can be connected through radial fingers 113 (FIG. 12) which can be made of a resilient material to a valve finger hub 114. The valve finger hub 114 can be secured to the rear side of the valve plate assembly 62 by the rivet 107. Optionally, the cylinder head 61 can have a head rib 118 (FIG. 13) which can project over and can be spaced a distance from the valve members 112 to restrict movement of the exhaust valve members 112 and to lessen and control valve impact vibrations and corresponding valve stress.

Figure 15A:
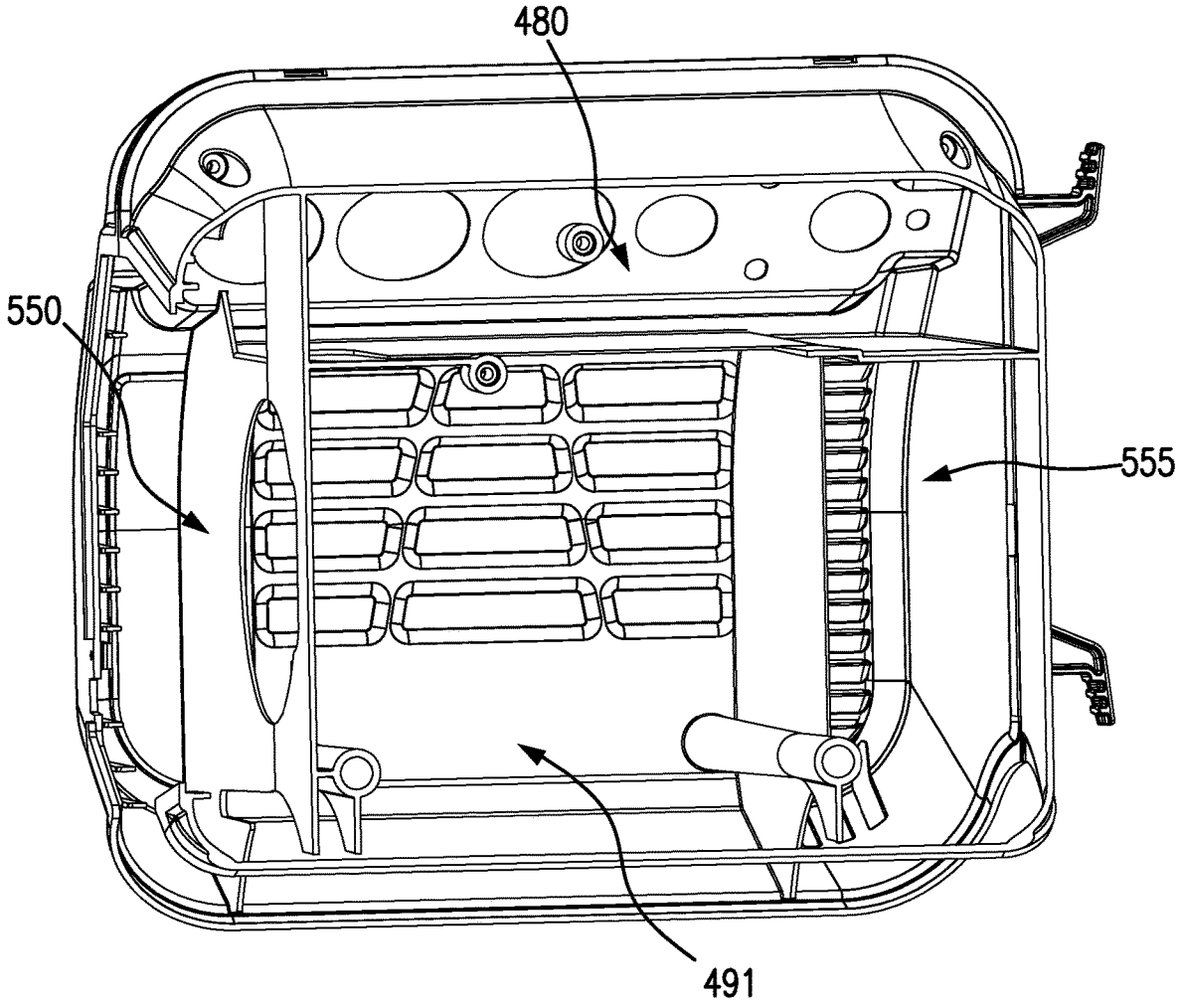
FIG. 15A is a perspective view of sound control chambers of the compressor assembly.

FIG. 15A is a perspective view of a plurality of sound control chambers of an embodiment of the compressor assembly 20. FIG. 15A illustrates an embodiment having four (4) sound control chambers. The number of sound control chambers can vary widely in a range of from one to a large number, e.g. 25, or greater. In non-limiting example, in an embodiment, a compressor assembly 20 can have a fan sound control chamber 550 (also herein as "fan chamber 550"), a pump sound control chamber 491 (also herein as "pump chamber 491"), an exhaust sound control chamber 555 (also herein as "exhaust chamber 555"), and an upper sound control chamber 480 (also herein as "upper chamber 480").

Figure 15B:
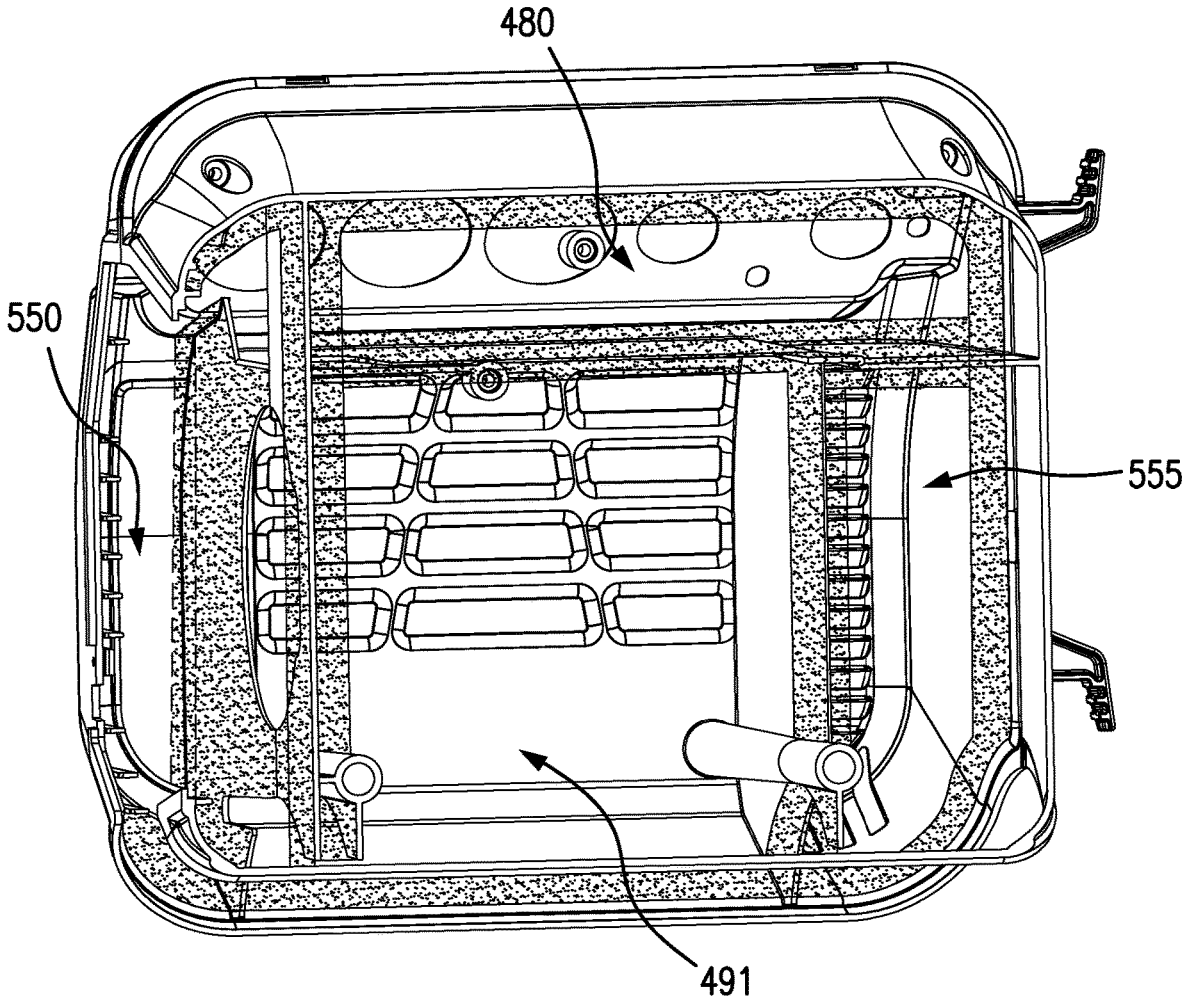
FIG. 15B is a perspective view of sound control chambers having optional sound absorbers.

FIG. 15B is a perspective view of sound control chambers having optional sound absorbers. The optional sound absorbers can be used to line the inner surface of housing 21, as well as both sides of partitions which are within the housing 21 of the compressor assembly 20.

Figure 16A:
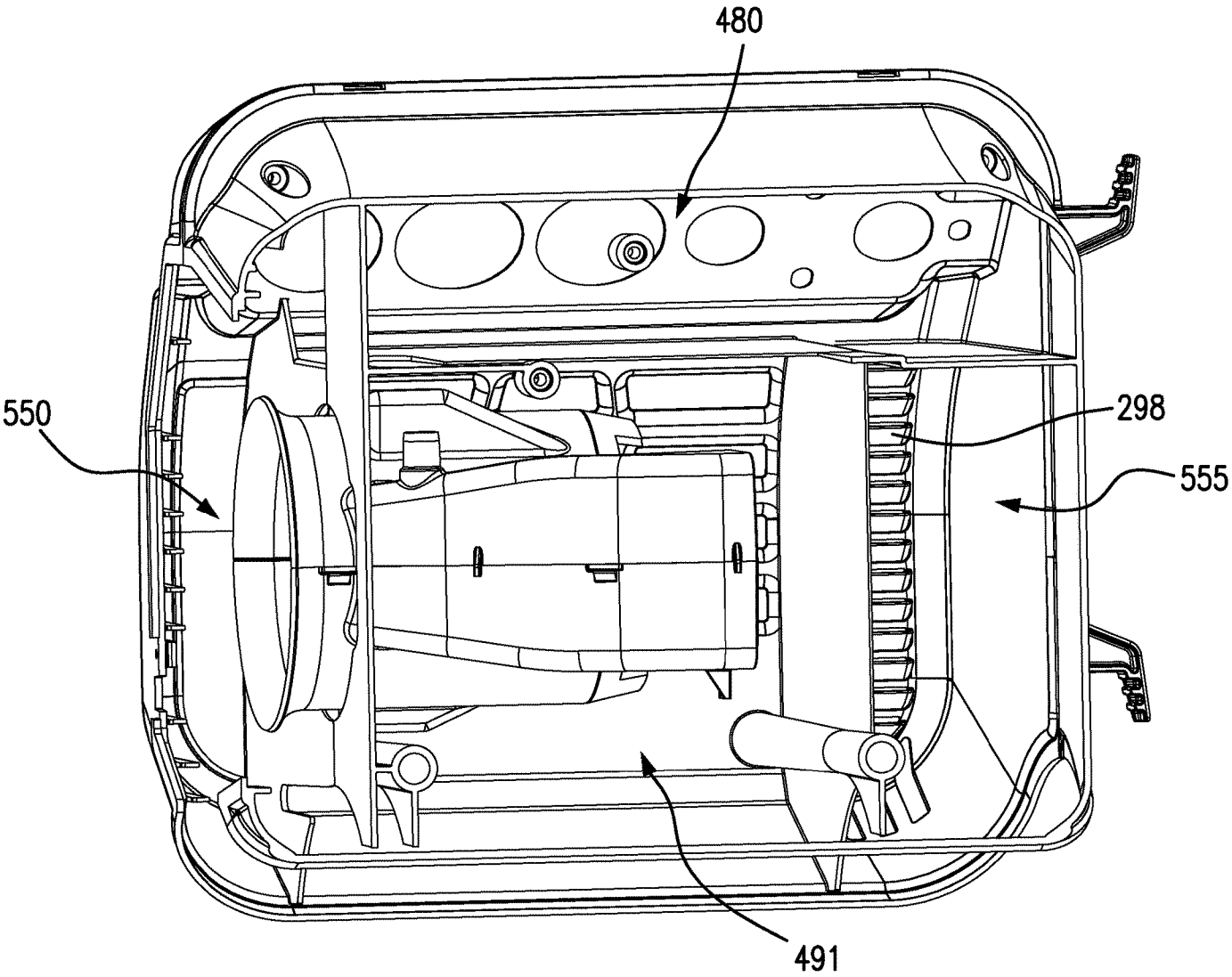
FIG. 16A is a perspective view of sound control chambers with an air ducting shroud.

FIG. 16A is a perspective view of sound control chambers with an air ducting shroud 485. FIG. 16A illustrates the placement of air ducting shroud 485 in coordination with, for example, the fan chamber 550, the pump sound control chamber 491, the exhaust sound control chamber 555, and the upper sound control chamber 480.

Figure 16B:
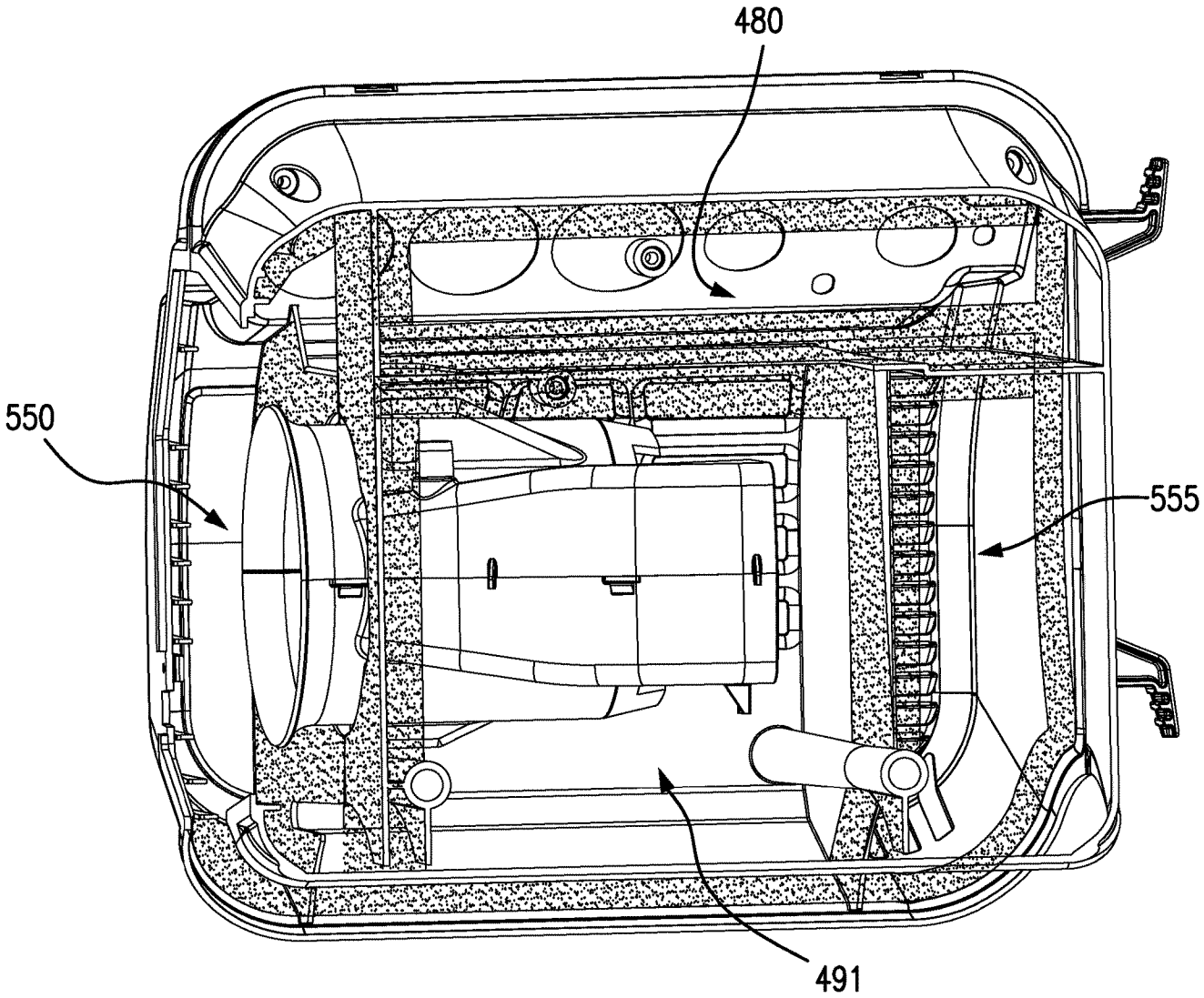
FIG. 16B is a perspective view of sound control chambers having optional sound absorbers.

FIG. 16B is a perspective view of sound control chambers having optional sound absorbers. The optional sound absorbers can be used to line the inner surface of housing 21, as well as both sides of partitions which are within the housing 21 of compressor assembly 20.

FIG. 17 is a first table of embodiments of compressor assembly range of performance characteristics. The compressor assembly 20 can have values of performance characteristics as recited in FIG. 17 which are within the ranges set forth in FIG. 17.

FIG. 18 is a second table of embodiments of ranges of performance characteristics for the compressor assembly 20. The compressor assembly 20 can have values of performance characteristics as recited in FIG. 18 which are within the ranges set forth in FIG. 18.

The compressor assembly 20 achieves efficient heat transfer. The heat transfer rate can have a value in a range of from 25 BTU/min to 1000 BTU/min. The heat transfer rate can have a value in a range of from 90 BTU/min to 500 BTU/min. In an embodiment, the compressor assembly 20 can exhibit a heat transfer rate of 200 BTU/min. The heat transfer rate can have a value in a range of from 50 BTU/min to 150 BTU/min. In an embodiment, the compressor assembly 20 can exhibit a heat transfer rate of 135 BTU/min. In an embodiment, the compressor assembly 20 exhibited a heat transfer rate of 84.1 BTU/min.

The heat transfer rate of a compressor assembly 20 can have a value in a range of 60 BTU/min to 110 BTU/min. In an embodiment of the compressor assembly 20, the heat transfer rate can have a value in a range of 66.2 BTU/min to 110 BTU/min; or 60 BTU/min to 200 BTU/min.

The compressor assembly 20 can have noise emissions reduced by e.g., slower fan and/or slower motor speeds, use of a check valve muffler, use of tank vibration dampeners, use of tank sound dampeners, use of a tank dampening ring, use of tank vibration absorbers to dampen noise to and/or from the tank walls which can reduce noise. In an embodiment, a two stage intake muffler can be used on the pump. A housing having reduced or minimized openings can reduce noise from the compressor assembly. As disclosed herein, the elimination of line of sight to the fan and other components as attempted to be viewed from outside of the compressor assembly 20 can reduce noise generated by the compressor assembly. Additionally, routing cooling air through ducts, using foam lined paths and/or routing cooling air through tortuous paths can reduce noise generation by the compressor assembly 20.

Additionally, noise can be reduced from the compressor assembly 20 and its sound level lowered by one or more of the following, employing slower motor speeds, using a check valve muffler and/or using a material to provide noise dampening of the housing 21 and its partitions and/or the compressed air tank 150 heads and shell. Other noise dampening features can include one or more of the following and be used with or apart from those listed above, using a two-stage intake muffler in the feed to a feed air port 952, elimination of line of sight to the fan and/or other noise generating parts of the compressor assembly 20, a quiet fan design and/or routing cooling air routed through a tortuous path which can optionally be lined with a sound absorbing material, such as a foam. Optionally, fan 200 can be a fan which is separate from the shaft 43 and can be driven by a power source which is not shaft 43.

In an example, an embodiment of compressor assembly 20 achieved a decibel reduction of 7.5 dBA. In this example, noise output when compared to a pancake compressor assembly was reduced from about 78.5 dBA to about 71 dBA.

Example 1

FIG. 19 is a first table of example performance characteristics for an example embodiment. FIG. 19 contains combinations of performance characteristics exhibited by an embodiment of compressor assembly 20.

Example 2

FIG. 20 is a second table of example performance characteristics for an example embodiment. FIG. 20 contains combinations of further performance characteristics exhibited by an embodiment of compressor assembly 20.

Example 3

FIG. 21 is a table containing a third example of performance characteristics of an example compressor assembly 20. In the Example of FIG. 21, a compressor assembly 20, having an air ducting shroud 485, a dampening ring 700, an intake muffler 900, four sound control chambers, a fan cover, four foam sound absorbers and a tank seal 600 exhibited the performance values set forth in FIG. 21.

The pump assembly 25 (e.g. FIG. 22) can be mounted to the air tank 150 and can have the housing 21. The housing 21 can have one or more openings through which noise generated by the pump assembly 25 can pass. One such opening can be around the base of the housing 21 where the shroud is proximate to the air tank and herein is exemplified by a tank gap 599. In an embodiment, noise emitted by compressor assembly 20 can be reduced by sealing the tank gap 599, e.g. with a tank seal 600 (e.g. FIG. 24)

Parts, for example, the tank seal 600 (e.g. FIG. 24), can be designed to minimize, eliminate and/or seal, the tank gap 599. In embodiments, the tank gap 599 can be sealed or closed by the tank seal 600.

The fewer openings which are present in the housing 21, the less total open area exists in the housing for noise to escape through unabated. In an embodiment, other openings, or gaps which exist in the housing 21 of the compressor assembly 20, or pieces or components thereof, can be eliminated, closed or sealed to reduce the noise emitted from the compressor assembly 20. In an embodiment, openings or gaps associated with one or a plurality of quick connections, such as the first quick connection 305 and the second quick connection 310, or with one or a plurality of a pressure regulator 320 can be eliminated, closed or sealed to reduce the noise emitted from the compressor assembly 20. In an embodiment, gaps around the dashboard 300 or the manifold 303 can be sealed or blocked by foam to reduce the noise emitted by the compressor assembly 20. In an embodiment, the sound level of a compressor assembly 20 can be reduced by reducing the amount of openings present in the housing 21, or pieces thereof.

Figure 22:
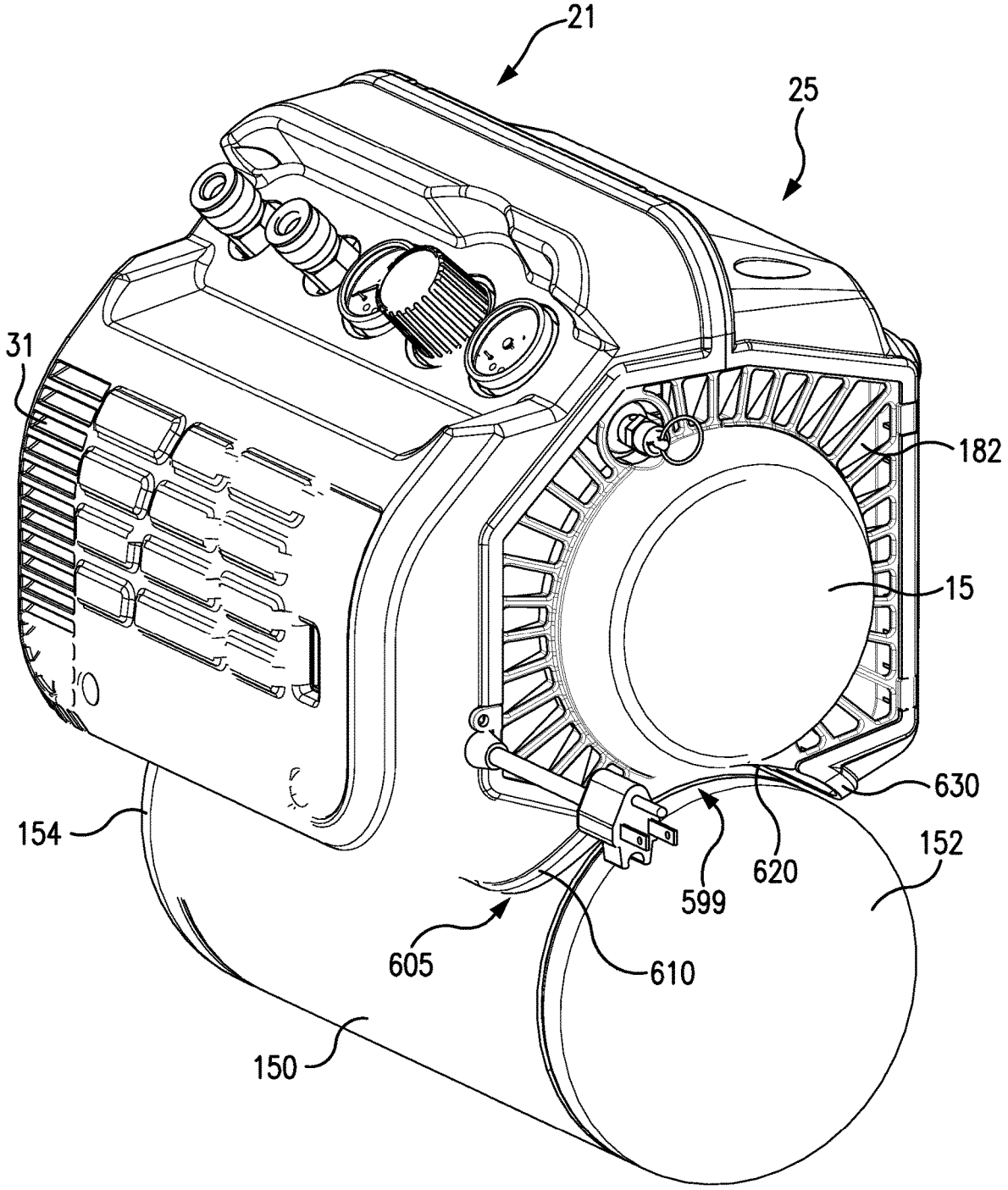
FIG. 22 is a perspective view of a pump assembly and compressed gas tank having a tank gap.

FIG. 22 is a perspective view of a pump assembly 25 and the compressed gas tank 150 having the tank gap 599. FIG. 22 illustrates the tank gap 599 located between the compressed gas tank 150 and a housing rim 605. In an embodiment, the housing rim 605 can have a front housing rim 610, a fan-side housing rim 620, a rear housing rim 630 and a pump-side housing rim portion 640 (e.g. FIG. 29). The pump-side housing rim portion 640 can have portions of the front housing rim 610 and the rear housing rim 630.

Figure 23:
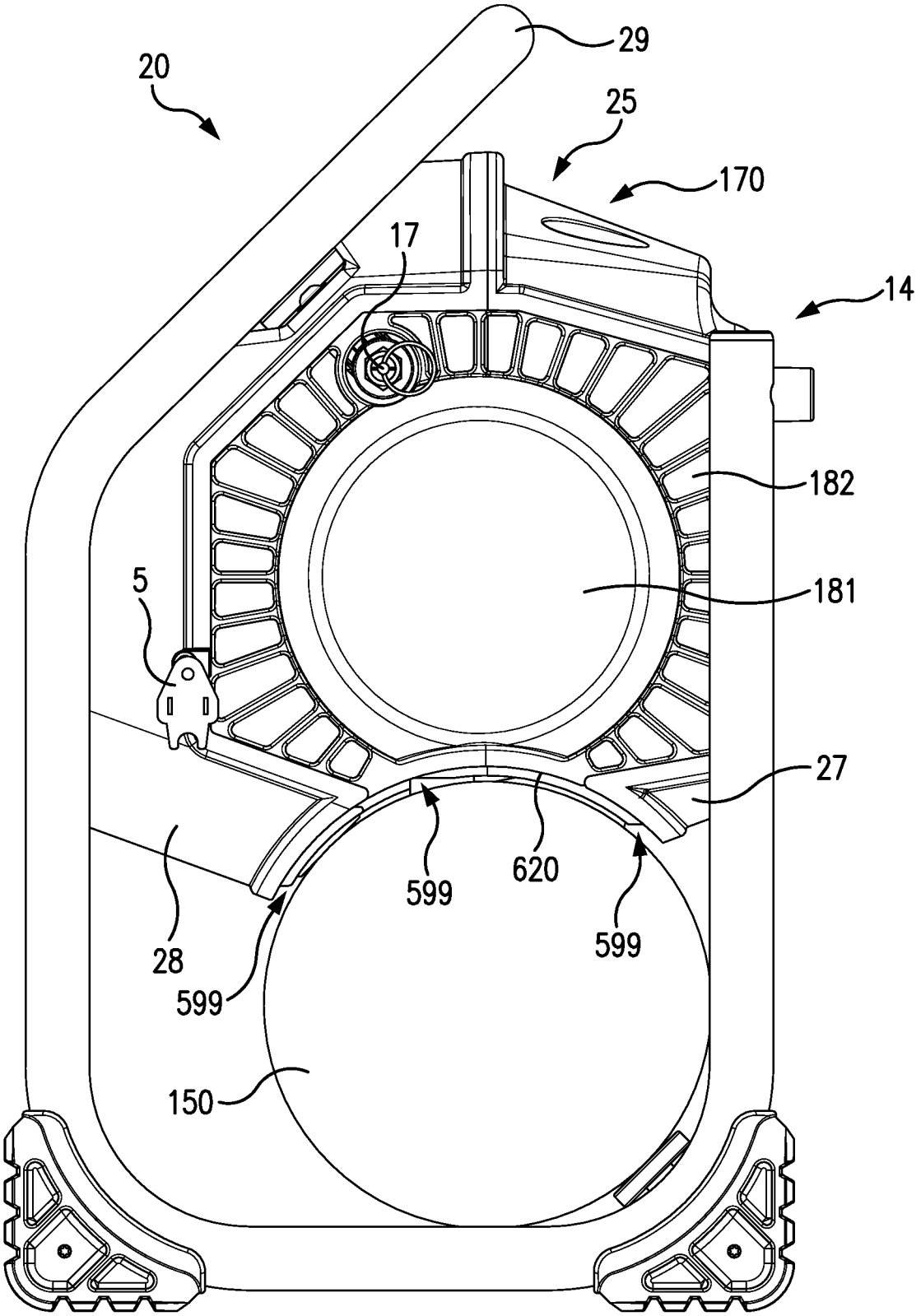
FIG. 23 is a fan-side view of a pump assembly and compressed gas tank having a tank gap.

FIG. 23 is a fan-side view of a pump assembly 25 and the compressed gas tank 150 having a tank gap 599. The fan-side portion of the tank gap 599 is located between the compressed gas tank 150 and a housing rim 605.

Figure 24:
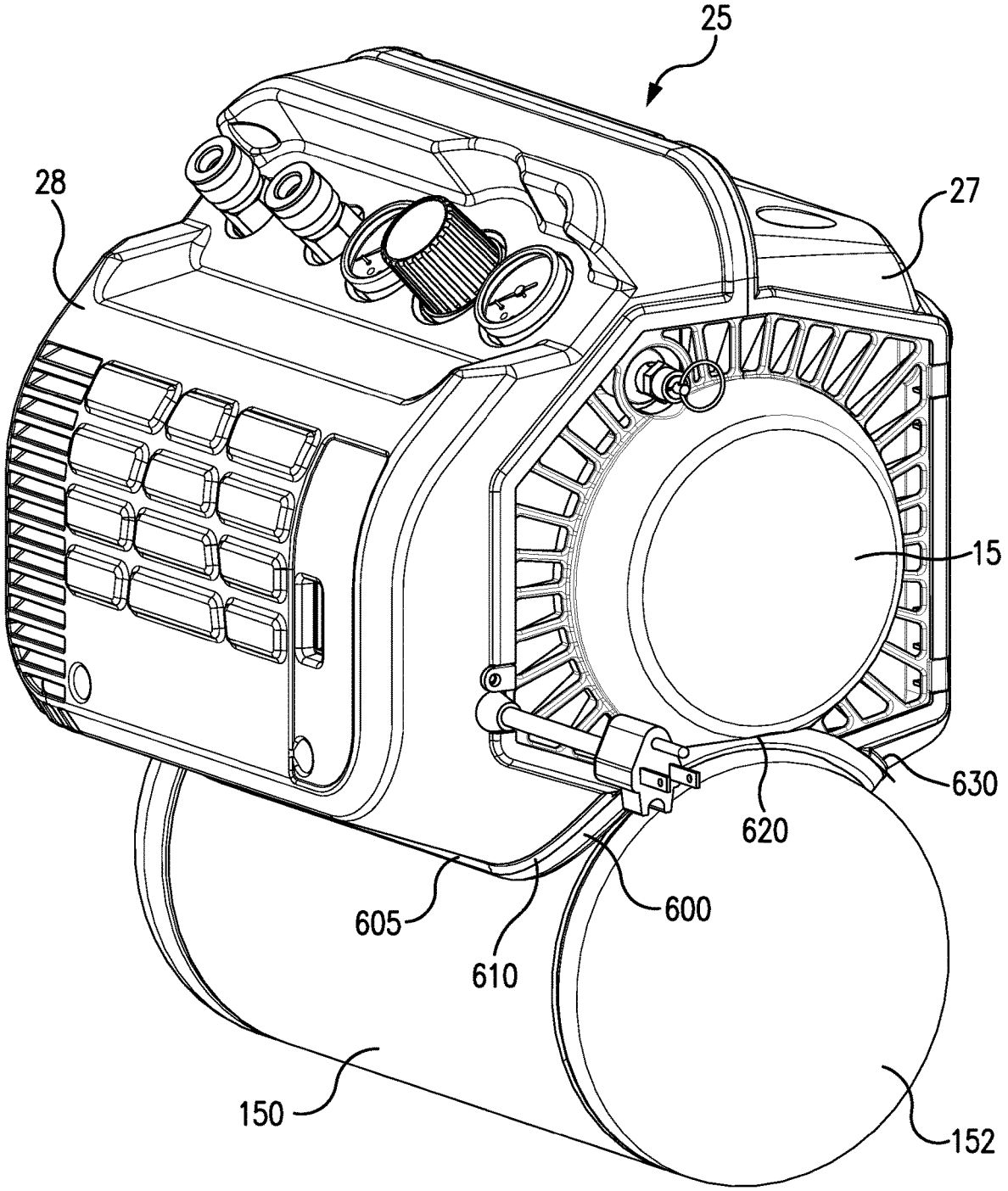
FIG. 24 is a perspective view of a pump assembly and compressed gas tank having a tank seal.

FIG. 24 is a perspective view of the pump assembly 25 and the compressed gas tank 150 having a tank seal 600 for sealing the tank gap 599. The tank seal 600 can be fit between the housing rim 605 and the compressed gas tank 150 to seal the tank gap 599. The tank seal 600 can seal or close the tank gap 599 to reduce sound emitted through the tank gap 599.

The tank gap 599 can have a distance between the housing rim 605 and the compressed gas tank 150 which can have a value in e.g. a range of from 0.01 in to 6 in, or e.g. a range of from 0.05 in to 5 in. In an embodiment, the distance between the housing rim 605 and the compressed gas tank 150 can have a value in a range of from 1.0 in to 2.0 in. In an embodiment, the distance between the housing rim 605 and the compressed gas tank 150 can have a value in a range of from 0.15 in to 1.0 in. In an embodiment, the distance between the housing rim 605 and the compressed gas tank 150 can have a value in a range of from 0.05 in to 0.75 in. In an embodiment, the housing rim 605 can have a value of 0.250 in.

There can also be a distance between the closest portion of the pump assembly 25 components and the compressed gas tank 150 which can have a value in a range of from 0.1 in to 8 in. In an embodiment, a sound absorbing cushion can be placed between the pump assembly 25 and the compressed gas tank 150.

The use of a tank seal 600 can achieve a noise reduction having a value in a range of from 0.5 dBA to 15 dBA, or a greater. In further embodiments, the use of a tank seal 600 can achieve a noise reduction having a value in a range of from 0.5 dBA to 10 dBA; or from 0.5 dBA to 7 dBA; or from 1.4 dBA to 15 dBA; or from 5 dBA to 10 dBA; or from 0.5 dBA to 8 dBA; or from 0.5 dBA to 5 dBA; or from 5 dBA to 8 dBA.

In an embodiment, a decibel reduction of 2.5 dBA can be achieved by using a tank seal 600 to reduce the noise output of a compressor assembly 20. In this example embodiment, the noise output of a compressor assembly 20 can be reduced from 70.5 dBA to 68 dBA using a tank seal 600.

The tank gap 599 can be sealed by a tape, or a duct tape, or a foam tape, or a rubber tape, or a Gorilla Tape® (The Gorilla Glue Company, 4550 Red Bank Expressway Cincinnati, Ohio 45227). Alternatively, the tank gap 599 can be sealed by an expandable spray foam, a caulk or a silicone. The tank gap 599 can also be sealed by a cushion material including, but not limited to, a cloth, felt, or other type of strip or appropriately shaped material which can conform in shape, of deform, to seal tank gap 599. The rubber or rubber-like material could be over-molded onto the housing rim 605. In an embodiment, the rubber or rubber-like material could be manufactured as a separate piece for assembly as a seal. For example, the tank gap 599 can be sealed by over-molding on the shroud with low durometer material, or other material. Alternatively, the tank gap 599 can be sealed by a foam strip. For example, the tank gap 599 can be sealed by a mat, a tank blanket, a foam or other tank covering onto which the housing rim 605 can be set and which can seal the tank gap 599. In an embodiment, an ethylene propylene diene monomer (EPDM) sponge rubber can be used to seal or fill gaps or openings and/or to reduce or muffle noise.

In an embodiment, tank gap 599 can be closed and/or sealed by a rubber or foam strip which can be attached to the shroud, or the tank, or held by frictional attachment, so that the rubber or foam strip can fill the gap when the parts are assembled, thus providing a seal to prevent an amount of noise from escaping from compressor assembly 20 through tank gap 599 and/or emanating from compressor assembly 20.

Figure 25:
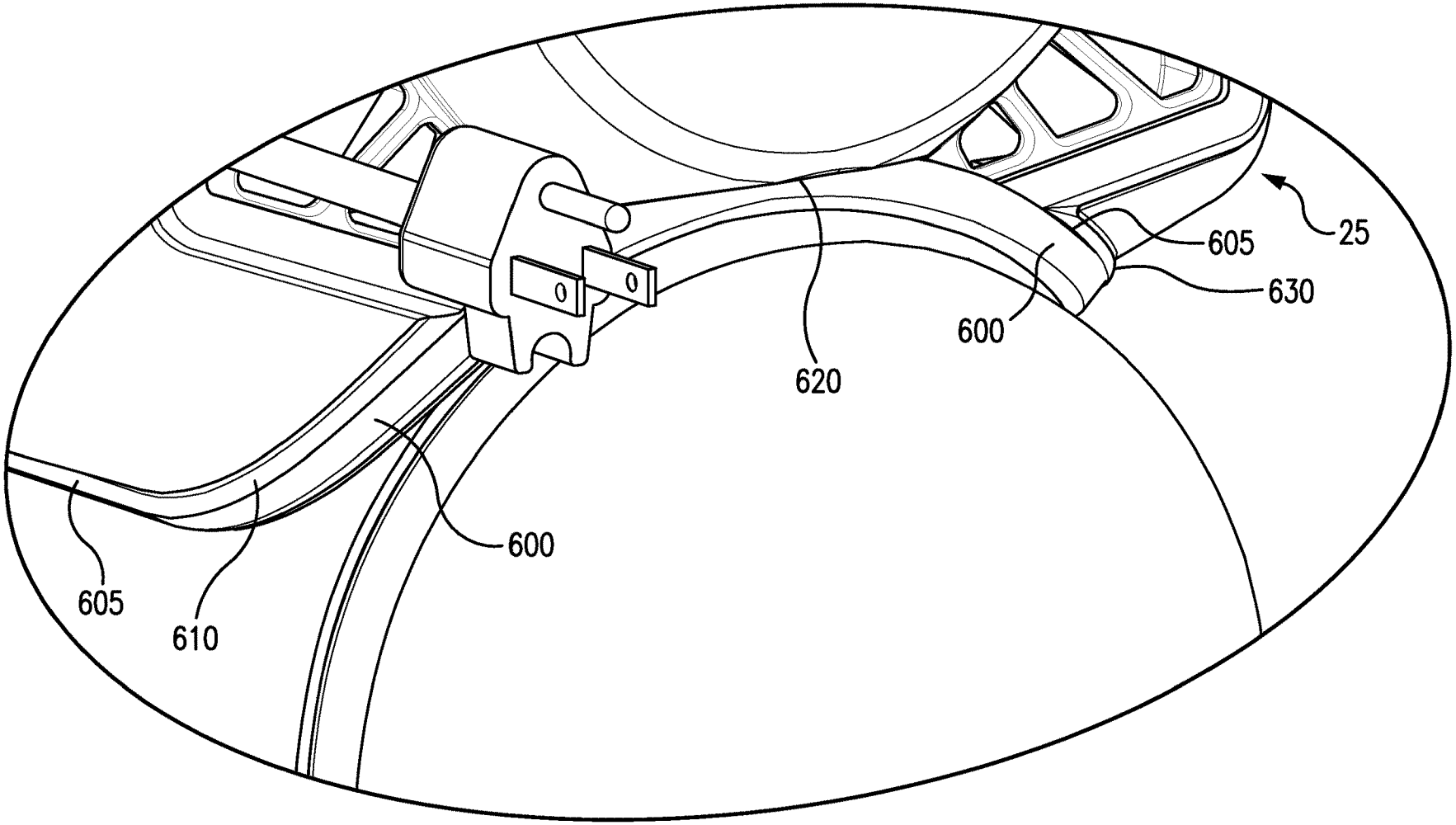
FIG. 25 is a detail of the tank seal of FIG. 24.

FIG. 25 is a detail of the tank seal 600 of FIG. 24 sealing the tank gap 599 by being fit between the housing rim 605 and compressed gas tank 150.

Figure 26:
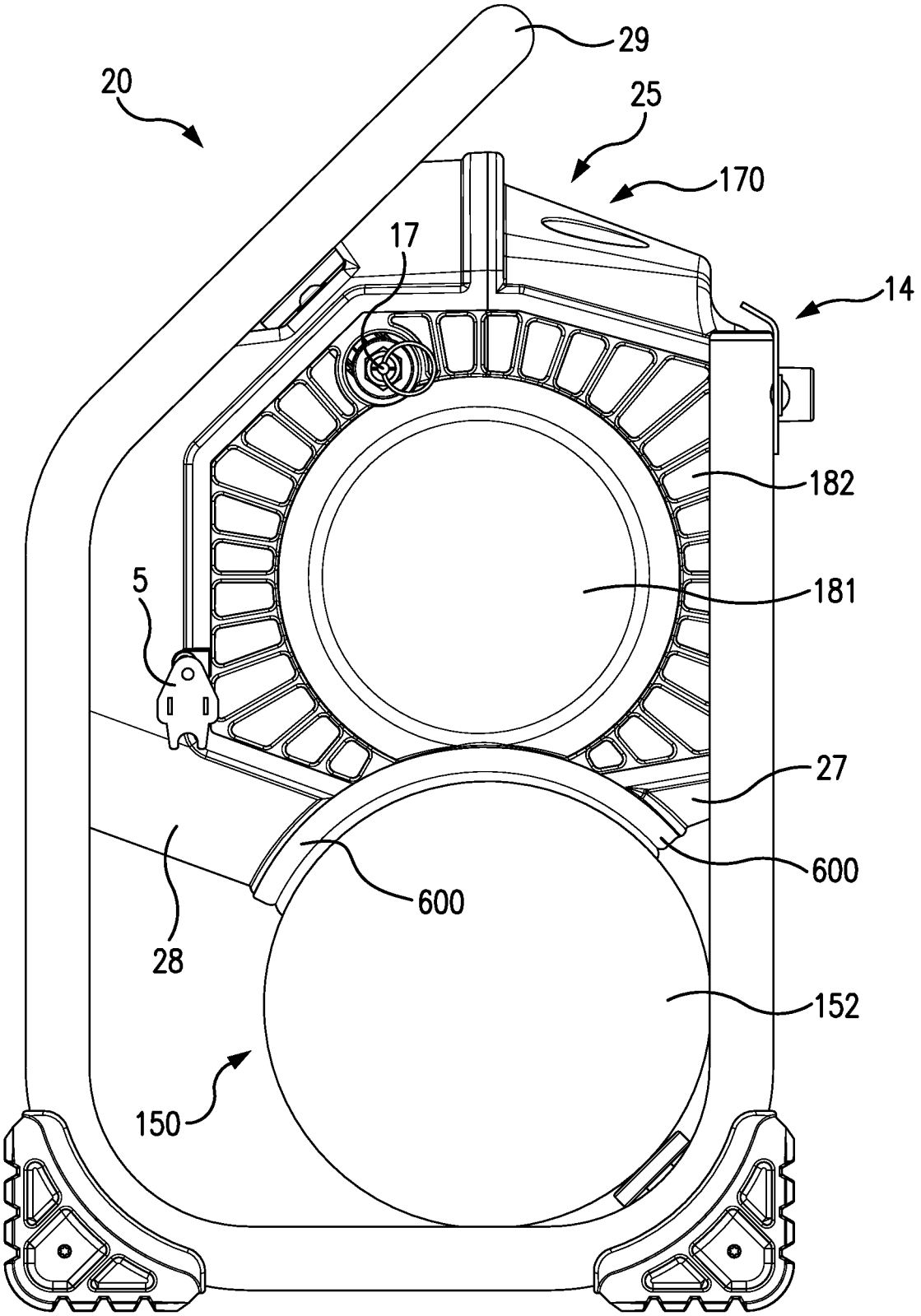
FIG. 26 is a fan-side view of a pump assembly and compressed gas tank having a tank seal.

FIG. 26 is a fan-side view of the pump assembly 25 and compressed gas tank 150 having the tank seal 600.

Figure 27:
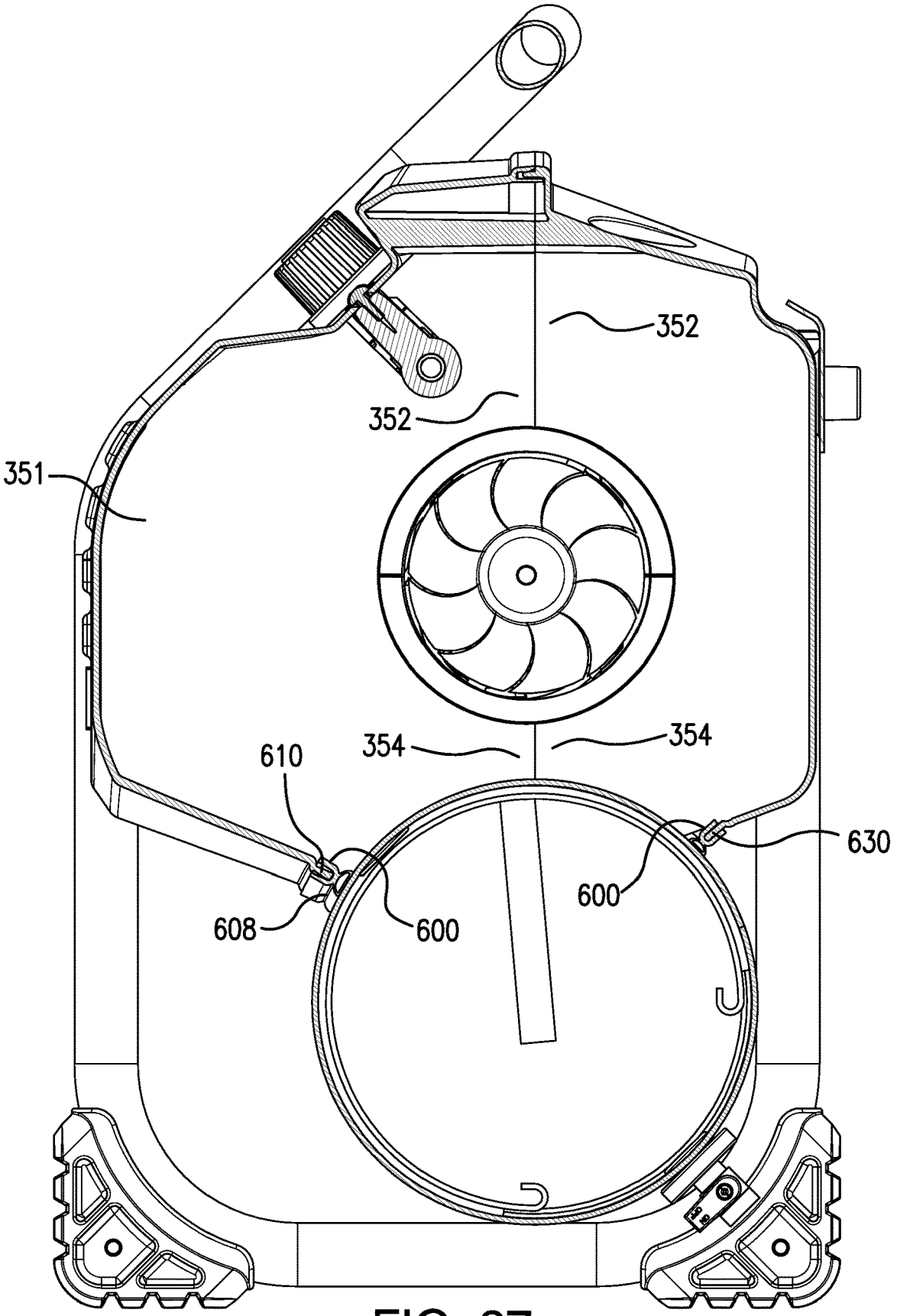
FIG. 27 is a fan-side sectional view of a pump assembly and compressed gas tank having a tank seal.
Figure 31:
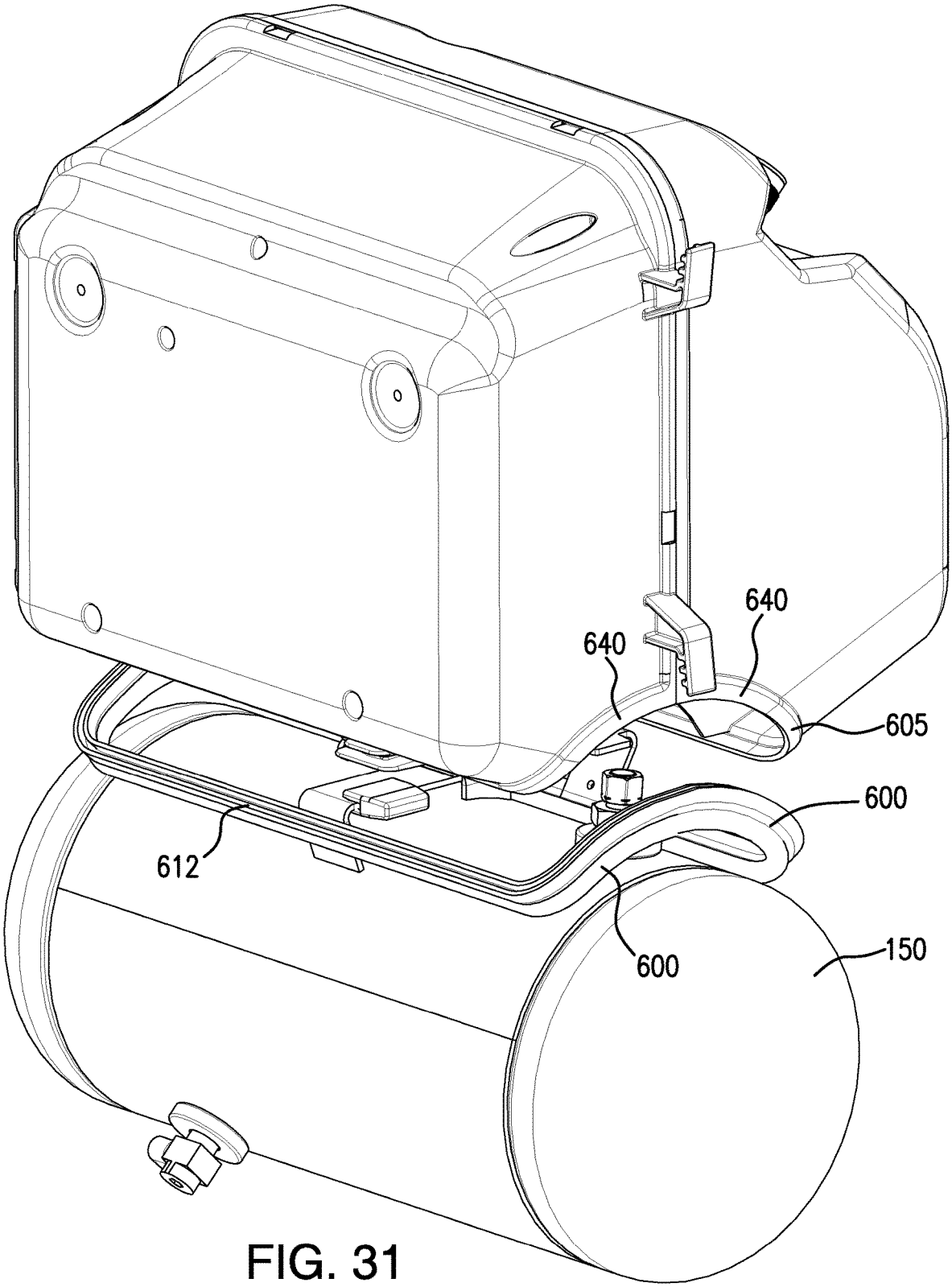
FIG. 31 is an exploded rear perspective view of a pump assembly and compressed gas tank having a tank seal.

FIG. 27 is a fan-side sectional view of a pump assembly 25 and compressed gas tank 150 having a tank seal 600. The tank seal is shown in a sectional view of a front seal portion 608 and a rear seal portion 612 (FIG. 31).

Figure 28A:
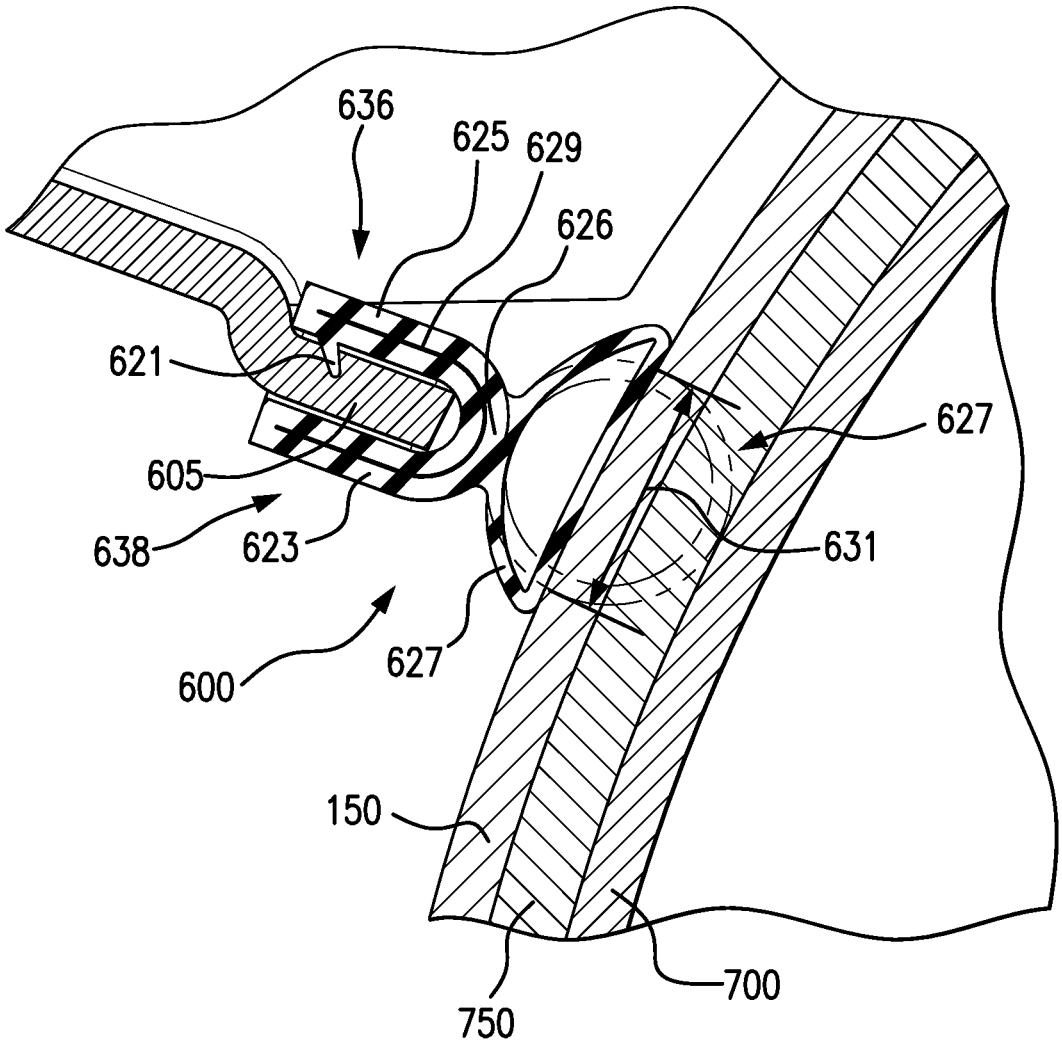
FIG. 28A is a detail of a tank seal.

FIG. 28A is an exemplary detail of the tank seal. The tank seal 600 has a housing seal 623 optionally connected to a seal bulb 627. In an embodiment, housing seal 623 can be U-shaped, V-shaped or other shape to mate with housing rim 605. In an embodiment, the housing seal 623 can have seal hook 621. In an embodiment, the seal hook 621 can engage with a portion of housing rim 605. In an embodiment, the housing seal 623 can optionally have a seal rib 629. In an embodiment, the seal rib 629 can be metal, plastic, rubber, fiberglass, carbon fiber, or a rigid or a semi-rigid material.

In an embodiment, the tank seal 600 can be compressed under a force having a value in a range of from 0.25 lbf/in^2 to 50 lbf/in^2, or greater.

In an embodiment, the seal bulb 627 can have a seal bulb outer diameter 631 (also herein as "seal bulb OD 631"; see also FIG. 28B) from 0.15 in to 3.0 in, or greater. In an embodiment, the seal bulb OD 631 can be 0.25 in. In an embodiment, the seal bulb OD 631 can be 0.375 in. In an embodiment, the seal bulb OD 631 can be 0.5 in. In an embodiment, the seal bulb OD 631 can be 0.75 in.

The seal bulb 627 can have an outer diameter, when not compressed of, e.g. 0.375 in. When compressed, the seal bulb 627 can change shape, or deform, under force to a shape which can conform to at least a portion of the compressed gas tank 150 and which can seal the tank gap 599.

The housing seal base portion 626 (FIG. 28A) of the housing seal 623 and the seal bulb 627 in a compressed state can seal or close the tank gap 599.

In an embodiment, the tank seal 600 can have a pump assembly side 636 and an outside 638. A difference in sound level across the tank seal 600 as measured from a location on or proximate to the pump assembly side 636 to a location on or proximate to the outside 638 can be a value in a range of from 0.25 dBA to 15 dBA. A difference in sound level across the tank seal 600 as measured from a location on or proximate to the pump assembly side 636 to a location on or proximate to the outside 638 can be a value in a range of from 0.3 dBA to 10 dBA. A difference in sound level across the tank seal 600 as measured from a location on or proximate to the pump assembly side 636 to a location on or proximate to the outside 638 can be a value in a range of from 2.0 dBA to 10 dBA. The difference in sound level across the tank seal 600 as measured at the aforementioned locations can have a value in a range of from 2.5 dBA to 8 dBA, in a range of from 5 dBA to 8 dBA.

Figure 28C:
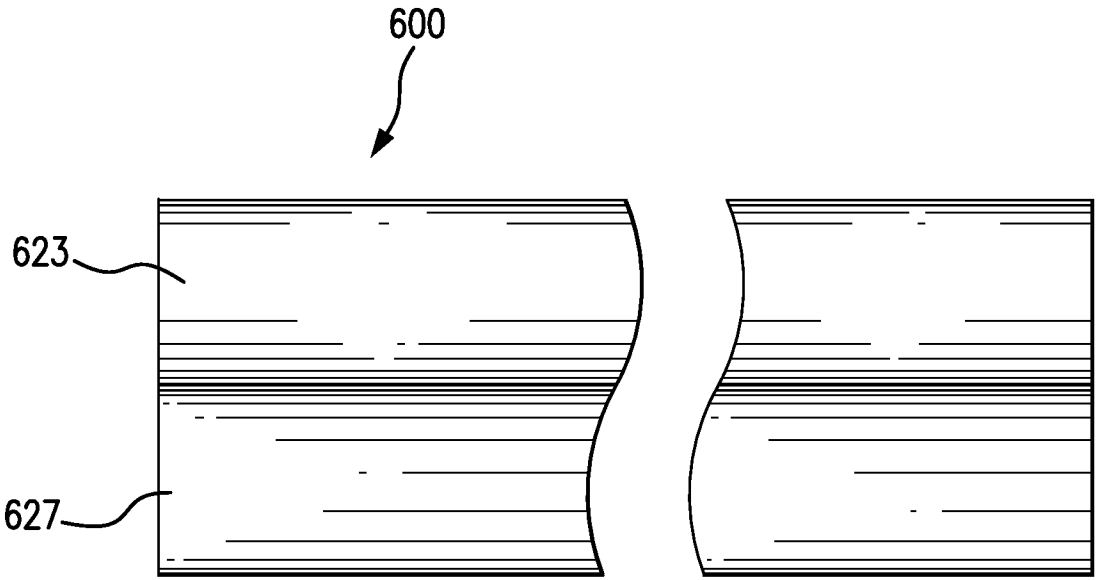
FIG. 28C is a side view of a tank seal.
Figure 28B:
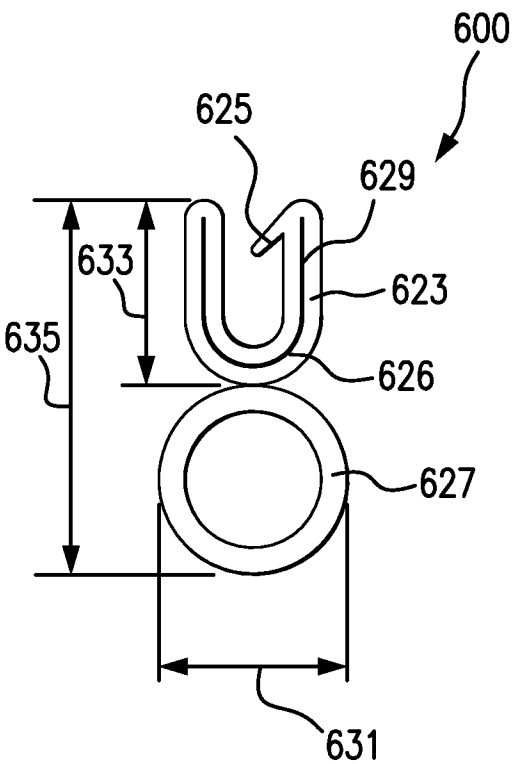
FIG. 28B is a cross-sectional view of a tank seal.

FIG. 28B is a cross-sectional view of a tank seal identifying a housing fitting height 633. The housing fitting height can be the height of the U-shaped portion of the seal 600. In an embodiment, the housing fitting height 633 can have a value in a range of 0.15 in to 6.0 in, or greater. In an embodiment, the housing fitting height 633 can be 0.25 in. The housing fitting height 633 can be 0.375 in. In an embodiment, the housing fitting height 633 can be 0.5 in. In an embodiment, the housing fitting height 633 can be 1 in, or greater. The seal height 635 of seal 600 can range, e.g. from 0.3 in to 6 inches, or greater.

In an embodiment, in which seal 600 is over-molded onto the housing rim 605 the height of such over-molded seal can be less than 0.3 in, an can have a range of e.g. from 0.1 in to 3.0 in, or greater.

FIG. 28C is a side view of a tank seal 600.

Figure 29:
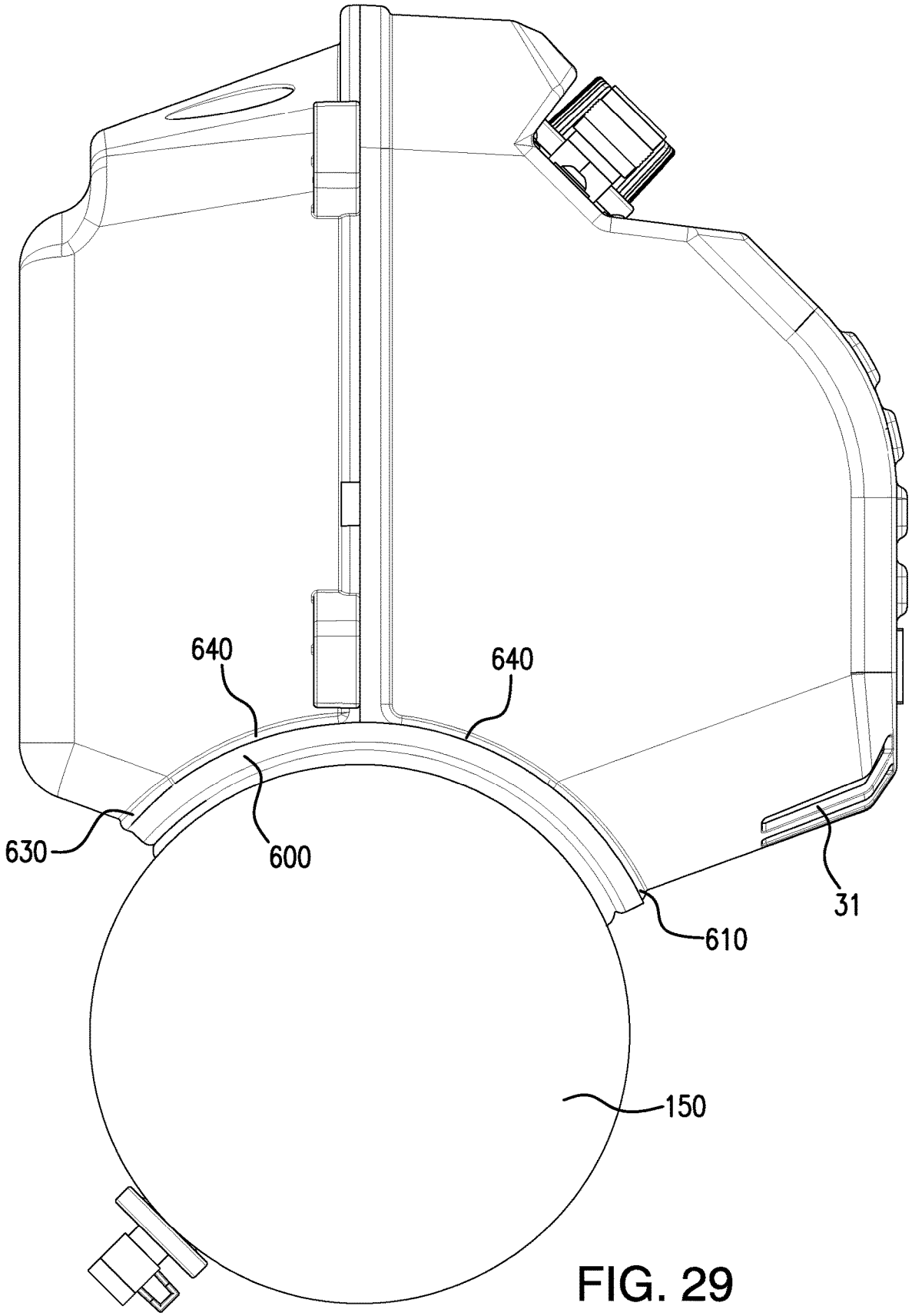
FIG. 29 is a pump-side view of a pump assembly and compressed gas tank having a tank seal.

FIG. 29 is a pump-side view of a pump assembly 25 and compressed gas tank 150 having tank seal 600 which can seal the tank gap 599 between the housing rim 605 and compressed gas tank 150.

Figure 30:
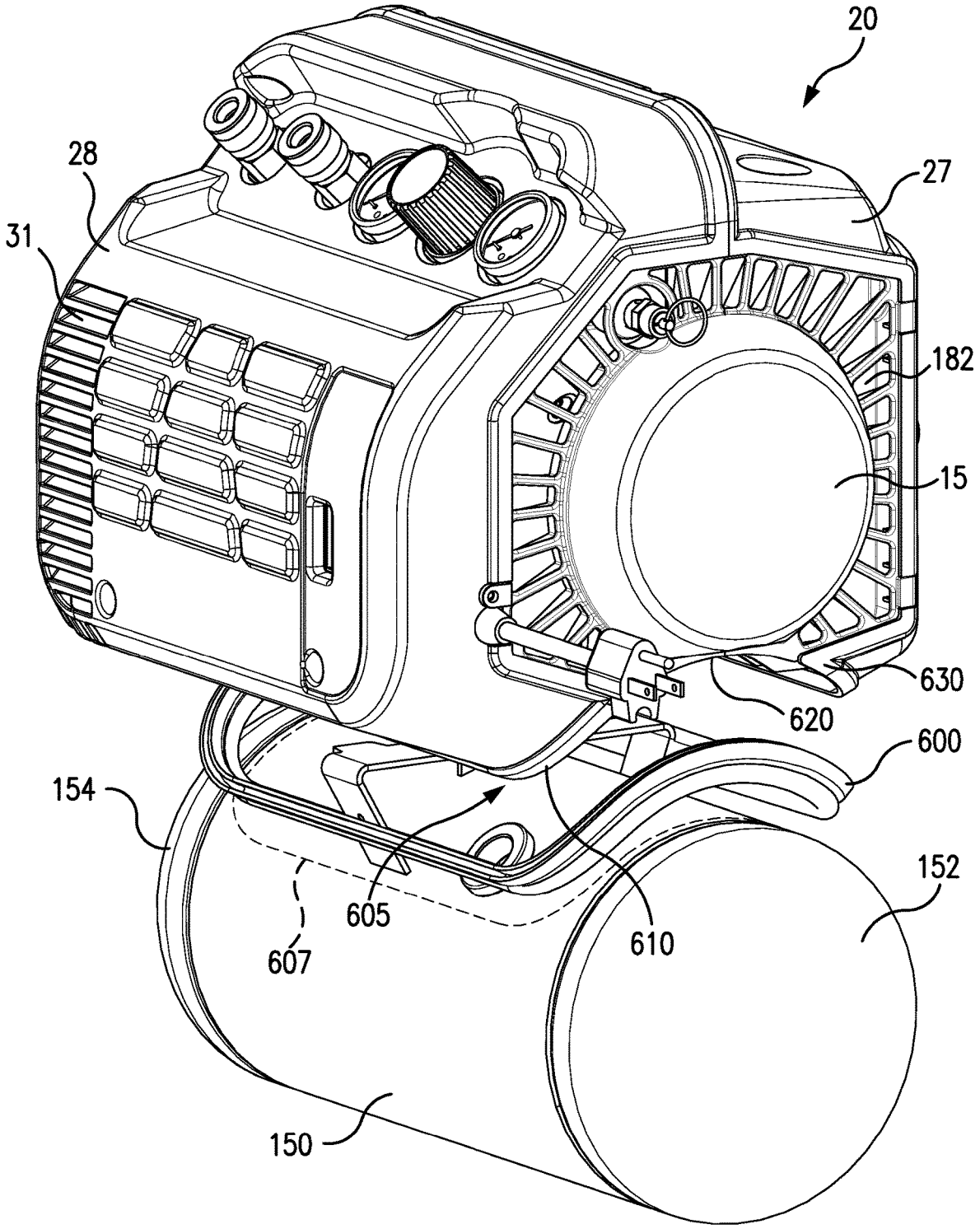
FIG. 30 is an exploded front perspective view of a pump assembly and compressed gas tank having a tank seal.

FIG. 30 is an exploded front perspective view of the pump assembly 25 and compressed gas tank 150 having the tank seal 600. In FIG. 30, the housing rim 605 can have the front housing rim 610, the fan-side housing rim 620, the rear housing rim 630 and the pump-side housing rim 640 (FIG. 31). FIG. 30 also shows tank seal 600 apart from the compressed gas tank 150. In FIG. 30, the housing rim 605, tank seal 600 and tank seal line 607 are illustrated separately in an alignment to illustrate how an assembly can bring these pieces together. Assembly of these pieces can be accomplished by a variety of methods. In an embodiment, the tank seal 600 can be assembled between the housing rim 605 and the compressed gas tank 150 as illustrated in e.g. FIGS. 30 and 31 which can be assembled as in e.g. FIG. 24.

FIG. 31 is an exploded rear perspective view of the pump assembly 25 and compressed gas tank 150 having the tank seal 600.

Figure 32:
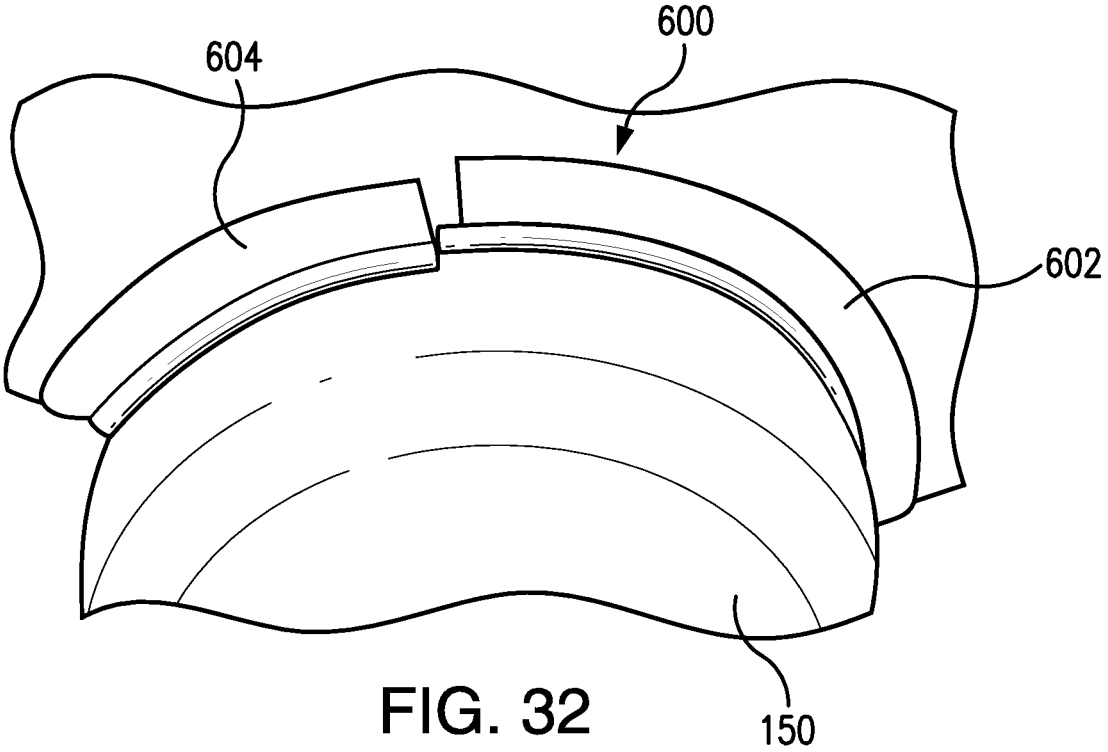
FIG. 32 is an embodiment of a tank seal.

FIG. 32 is an embodiment of the tank seal 600. In this example, the tank seal 600 has a first seal portion 602 and second seal portion 604.

Figure 33:
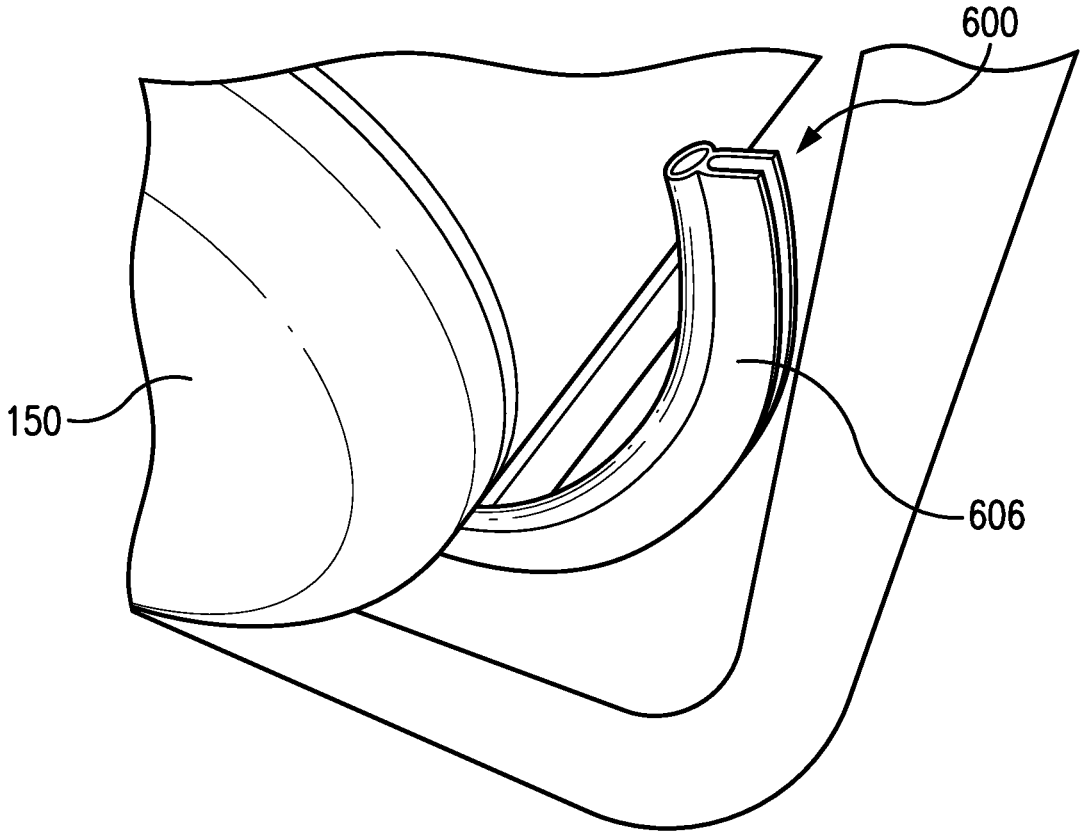
FIG. 33 is a view having piece of a tank seal which is detached.

FIG. 33 is a view having piece of a tank seal 600 which, for illustrative purposes, has a seal 606 portion which is shown not in contact with compressed air tank 150. FIG. 33 thus illustrates an uncompressed state of the portion not in contact with the compressed gas tank 150.

Figure 34:
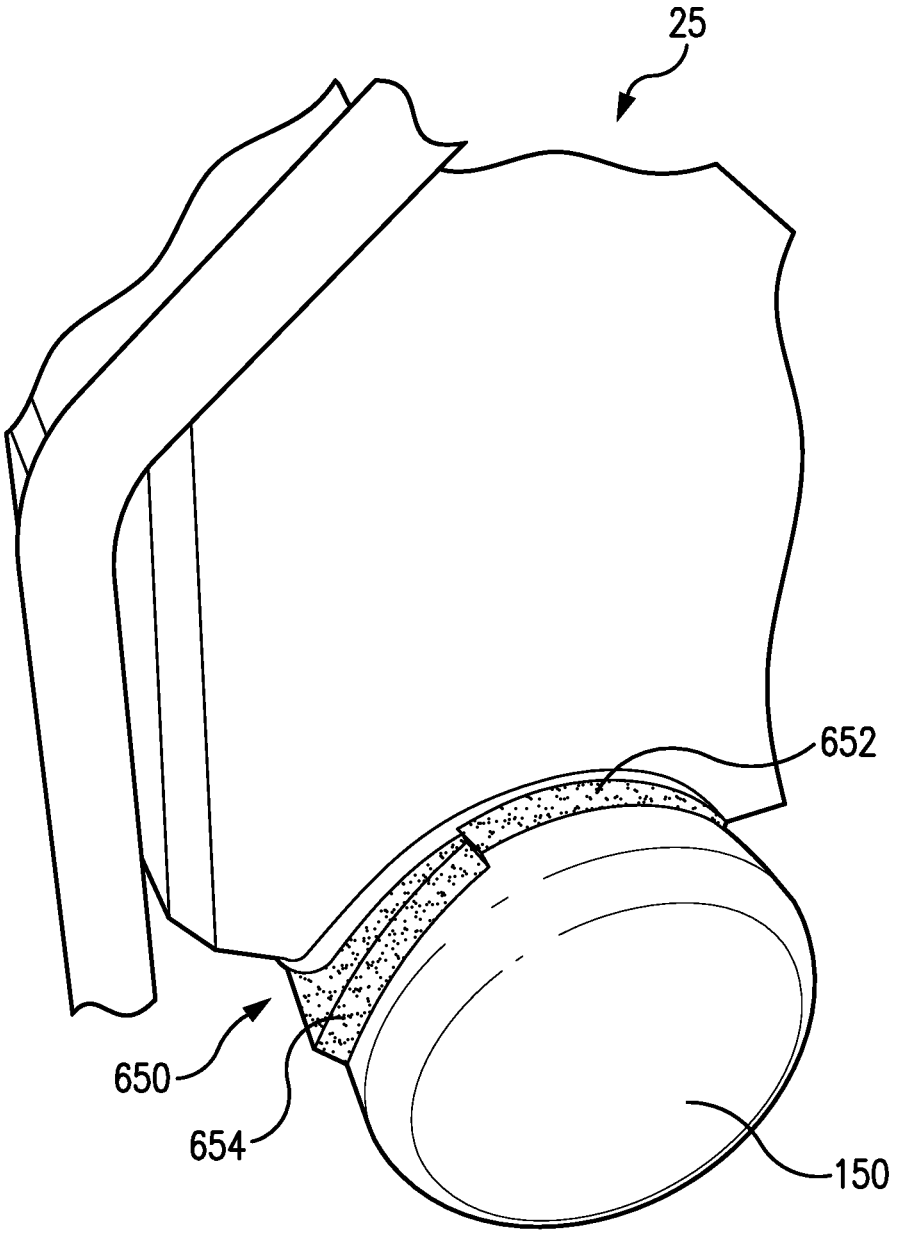
FIG. 34 illustrates an embodiment of a tank seal made of foam.

FIG. 34 illustrates an embodiment of a tank seal made of foam and forming a foam barrier 650 which can provide a barrier between a noise source and an operator to achieve a reduction in noise. FIG. 34 illustrates a portion of a foam barrier 650, which can have a first foam barrier 652 and a second foam barrier 654.

Foam can be used to muffle the noise from the plurality of exhaust ports 31. In an embodiment, the foam can have a porosity to allow exiting exhaust air flow through the plurality of exhaust ports 31 for sufficient cooling. In an embodiment, foam can be used to muffle the noise from the intake ports 182 for the cooling air.

In an embodiment, a sound absorbing foam can be, e.g. a polyurethane foam and can have a value of density in a range from 0.8 lb/ft^3 to 5.0 lb/ft^3. The foam can be used as a tank seal 600 forming a noise barrier or sound absorber. In an embodiment, the foam can have a value of density in a range from 1.6 lb/ft^3 to 2.0 lb/ft^3, or e.g. have a value of density of 1.8 lb/ft^3, and can be used as the tank seal 600 to form a noise barrier or sound absorber. In an embodiment, the foam can be flame retardant. In an embodiment, the foam can be used in the pump chamber 491 which can contain at least the pump and motor components to reduce noise emissions from at least the pump assembly 25. In an embodiment, a foam material can cover at least a portion of the tank surface which is present in the pump chamber 491.

The scope of this disclosure is to be broadly construed. It is intended that this disclosure disclose equivalents, means, systems and methods to achieve the devices, designs, operations, control systems, controls, activities, mechanical actions, fluid dynamics and results disclosed herein. For each mechanical element or mechanism disclosed, it is intended that this disclosure also encompasses within the scope of its disclosure and teaches equivalents, means, systems and methods for practicing the many aspects, mechanisms and devices disclosed herein. Additionally, this disclosure regards a compressor and its many aspects, features and elements. Such an apparatus can be dynamic in its use and operation. This disclosure is intended to encompass the equivalents, means, systems and methods of the use of the compressor assembly and its many aspects consistent with the description and spirit of the apparatus, means, methods, functions and operations disclosed herein. The claims of this application are likewise to be broadly construed.

The description of the inventions herein in their many embodiments is merely exemplary in nature and, thus, variations that do not depart from the gist of the invention are intended to be within the scope of the invention and the disclosure herein. Such variations are not to be regarded as a departure from the spirit and scope of the invention.

It will be appreciated that various modifications and changes can be made to the above described embodiments of a compressor assembly as disclosed herein without departing from the spirit and the scope of the following claims.

We claim:

1. A compressor assembly, comprising:

a housing which encloses at least in part each of a pump assembly and a universal motor having a motor speed in a range of 5,000 rpm to 20,000 rpm, said pump assembly having a reciprocating pump that is driven by a drive belt, said housing having a bottom housing portion which is proximate to a convex outer shell portion of a compressed gas tank;

a tank gap between said bottom housing portion and the convex outer shell portion of the compressed gas tank;

a tank seal which seals a portion of said tank gap between said bottom housing portion and at least a portion of the convex outer shell portion of said compressed gas tank and which contributes a sound reduction in a range of from 0.5 dBA to 15 dBA from the sound emitted from the compressor assembly when the compressor assembly is in a compressing state and that is measured in compliance with ISO3744-1995; and the compressor assembly having a sound level which is in a range of from 65 dBA to 75 dBA when the compressor assembly is in a compressing state and that is measured in compliance with ISO3744-1995.

2. The compressor assembly according to claim 1, wherein the sound level present on a pump assembly side of the tank seal is greater than the sound level outside of the tank seal by about 2 dBA to about 10 dBA, wherein the compared sound levels are each measured in compliance with ISO3744-1995.

3. The compressor assembly according to claim 1, wherein the sound level present on a pump assembly side of the tank seal and the sound level which is emitted by the compressor assembly outside of the tank seal is in a range of from about 2 dBA to about 8 dBA, wherein the compared sound levels are each measured in compliance with ISO3744-1995.

4. The compressor assembly according to claim 1, wherein the sound level present on a pump assembly side of the tank seal and the sound level which is emitted by the compressor assembly outside of the tank seal by about 2.5 dBA to about 5 dBA, wherein the compared sound levels are each measured in compliance with ISO3744-1995.

5. The compressor assembly according to claim 1, wherein the sound level present on a pump assembly side of the tank seal and the sound level which is emitted by the compressor assembly outside of the tank seal by about 5 dBA to about 8 dBA, wherein the compared sound levels are each measured in compliance with ISO3744-1995.

6. The compressor assembly according to claim 1, wherein the sound level present on a pump assembly side of the tank seal and the sound level which is emitted by the compressor assembly outside of the tank seal by about 2.5 dBA, wherein the compared sound levels are each measured in compliance with ISO3744-1995.

7. The compressor assembly according to claim 1, wherein the sound level present on a pump assembly side of the tank seal and the sound level which is emitted by the compressor assembly outside of the tank seal by about 5.0 dBA, wherein the compared sound levels are each measured in compliance with ISO3744-1995.

8. The compressor assembly according to claim 1, wherein the sound level present on a pump assembly side of the tank seal and the sound level which is emitted by the compressor assembly outside of the tank seal by about 8.0 dBA, wherein the compared sound levels are each measured in compliance with ISO3744-1995.

9. The compressor assembly according to claim 1, wherein the tank seal further comprises a seal bulb.

10. The compressor assembly according to claim 1, wherein the tank seal further comprises a housing seal.

11. The compressor assembly according to claim 1, wherein the tank seal further comprises a seal hook.

12. The compressor assembly according to claim 1, wherein the tank seal further comprises a seal rib.

13. The compressor assembly according to claim 1, wherein the tank seal further comprises seal bulb which can be compressed.

14. A method for controlling the sound level of a compressor assembly, comprising the steps of:

providing the compressor assembly having a pump assembly having a reciprocating pump that is driven by a drive belt and having a housing which encloses at least in part each of the pump assembly and a universal motor, said housing having a bottom housing portion having a housing rim and enclosing at least in part each of the pump assembly and the universal motor;

providing a compressed gas tank having a convex outer shell portion;

configuring the housing and the compressed gas tank to have a tank gap between the bottom housing portion and the convex outer shell portion of the compressed gas tank, said bottom housing portion proximate to a portion of said compressed gas tank;

providing a tank seal configured between the housing rim and the convex outer shell portion of the compressed gas tank; and at least in part sealing a portion of the tank gap with the tank seal, wherein the tank seal contributes a sound reduction in a range of from 0.5 dBA to 15 dBA from the sound emitted from the compressor assembly when the compressor assembly is in a compressing state and that is measured in compliance with ISO3744-1995.

15. The method for controlling the sound level of a compressor assembly according to claim 14, further comprising:

operating the compressor assembly in a compressing state at a sound level in a range of between 65 dBA and 75 dBA measured in compliance with ISO3744-1995.

16. The method for controlling the sound level of a compressor assembly according to claim 14, further comprising:

operating the compressor assembly in a compressing state at a sound level in a range of between 65 dBA and 75 dBA measured in compliance with ISO3744-1995, and compressing 2.4 SCFM to 3.5 SCFM of gas.

17. The method for controlling the sound level of a compressor assembly according to claim 14, further comprising:

operating the compressor assembly in a compressing state at a sound level in a range of between 65 dBA and 75 dBA measured in compliance with ISO3744-1995, and compressing gas to a pressure of 50 PSIG to 250 PSIG.

18. The method for controlling the sound level of a compressor assembly according to claim 14, further comprising:

transferring heat from the pump assembly at a rate of from 60 BTU/min to 200 BTU/min.

19. A compressor assembly, comprising:

a housing portion which encloses at least in part each of a pump assembly and a universal motor having a motor speed in a range of 5,000 rpm to 20,000 rpm, said housing portion having a bottom housing portion which is proximate to at least a portion of a compressed gas tank;

a tank gap between at least a portion of the bottom housing portion and a convex portion of the compressed gas tank;

a means to seal a portion of the tank gap which contributes a sound reduction in a range of from 0.5 dBA to 15 dBA from the sound emitted from the compressor assembly when the compressor assembly is in a compressing state and that is measured in compliance with ISO3744-1995; and wherein said pump assembly has a reciprocating pump that is driven by a drive belt;

wherein said compressor assembly has a sound level in a range of from 65 dBA to 75 dBA when the compressor assembly is in a compressing state and that is measured in compliance with ISO3744-1995.

20. The compressor assembly according to claim 19, wherein the means to seal the tank gap comprises a deformable portion.

* * * * *